US012290127B2

(12) United States Patent
Durocher et al.

(10) Patent No.: US 12,290,127 B2
(45) Date of Patent: May 6, 2025

(54) SYSTEMS AND METHODS FOR FASTENING A FACEGUARD TO A HELMET

(71) Applicant: Bauer Hockey, LLC, Exeter, NH (US)

(72) Inventors: Jacques Durocher, Saint-Jerome (CA); Carolyn Steele, Portsmouth, NH (US); Marie-Claude Genereux, Sainte-Therese (CA)

(73) Assignee: BAUER HOCKEY LLC, Exeter, NH (US)

( * ) Notice: Subject to any disclaimer, the term of this patent is extended or adjusted under 35 U.S.C. 154(b) by 71 days.

(21) Appl. No.: 17/060,697

(22) Filed: Oct. 1, 2020

(65) Prior Publication Data

US 2021/0093036 A1 Apr. 1, 2021

Related U.S. Application Data

(60) Provisional application No. 62/908,766, filed on Oct. 1, 2019.

(51) Int. Cl.
*A42B 3/20* (2006.01)
*A42B 3/22* (2006.01)

(52) U.S. Cl.
CPC ..... *A42B 3/20* (2013.01); *A42B 3/221* (2013.01)

(58) Field of Classification Search
CPC .. A42B 3/20; A42B 3/08; A42B 3/326; A42B 3/328; A42B 3/205; A42B 3/221; A42B 3/32; A42B 3/324; A42B 3/185; A42B 3/223; A63B 71/10; F16B 41/002
USPC ..... 2/9; 441/999; 411/999
See application file for complete search history.

(56) References Cited

U.S. PATENT DOCUMENTS 3,113,318 A * 12/1963 Marietta ..... A42B 3/20 2/9
3,189,918 A * 6/1965 Hiatt ..... A42B 3/225 2/9
3,260,989 A * 7/1966 Curtis ..... H01R 4/301 439/813
4,363,140 A * 12/1982 Correale ..... A42B 3/20 2/9
4,692,947 A * 9/1987 Black ..... A42B 3/08 2/9
4,833,726 A * 5/1989 Shinoda ..... A42B 3/30 455/90.3
4,881,654 A * 11/1989 Stazo ..... A01K 97/06 220/555

(Continued)

FOREIGN PATENT DOCUMENTS

CA 2145720 A * 9/1996 ..... A42B 3/20
FR 2593037 A * 7/1987 ..... A42B 3/222

OTHER PUBLICATIONS

Translation of FR-2593037-A (Year: 1987).*
Examiner's Report issued on Nov. 24, 2023 in connection with Canadian Patent Application No. 3095008, 3 pages.

*Primary Examiner* — Katherine M Moran
*Assistant Examiner* — Grady Alexander Nunnery

(57) ABSTRACT

A helmet for protecting a user's head is provided with a faceguard, in which fastening of the faceguard to the helmet is facilitated, including by retention of fastening hardware (e.g., one or more fasteners) on the faceguard before the faceguard is fastened to the helmet. This may be useful for the user or other individuals, such as at a retail store or other location selling or otherwise providing the helmet and/or the faceguard.

38 Claims, 27 Drawing Sheets

(56) References Cited

U.S. PATENT DOCUMENTS

| | | | | | |
|---|---|---|---|---|---|
| 4,907,296 | A * | 3/1990 | Blecha | A42B 3/042 | 2/6.2 |
| 5,095,552 | A * | 3/1992 | Parkinson | A42B 3/20 | 2/9 |
| 5,570,982 | A * | 11/1996 | Lautenschlager | F16B 41/002 | 411/355 |
| 5,839,868 | A * | 11/1998 | Kloian | F16B 21/20 | 411/905 |
| 7,567,306 | B2 * | 7/2009 | Park | A61F 9/023 | 349/13 |
| 2005/0015857 | A1 * | 1/2005 | Desjardins | A42B 3/324 | 2/418 |
| 2010/0251464 | A1 * | 10/2010 | Parisi | A42B 3/20 | 2/9 |
| 2013/0025032 | A1 * | 1/2013 | Durocher | A42B 3/324 | 2/414 |
| 2015/0201695 | A1 * | 7/2015 | Shih | A42B 3/20 | 2/9 |
| 2017/0042274 | A1 * | 2/2017 | Tatomir | A42B 3/221 | |
| 2017/0120134 | A1 * | 5/2017 | Warmouth | A42B 3/122 | |
| 2018/0338559 | A1 * | 11/2018 | Plunkett | A42B 3/14 | |
| 2019/0104800 | A1 * | 4/2019 | Schuster | A42B 3/225 | |

* cited by examiner

SYSTEMS AND METHODS FOR FASTENING A FACEGUARD TO A HELMET

CROSS-REFERENCE TO RELATED APPLICATIONS

This application claims priority from U.S. Provisional Patent Application No. 62/908,766, filed on Oct. 1, 2019 and hereby incorporated by reference herein.

FIELD

This disclosure relates generally to helmets (e.g., for playing hockey or other sports, etc.) and, more particularly, to helmets provided with faceguards (e.g., grids (a.k.a. "cages"), or visors).

BACKGROUND

Helmets are worn in sports (e.g., hockey) and other activities to protect their users against head injuries. To that end, helmets typically comprise a rigid outer shell and inner padding to absorb energy when impacted.

A helmet may be provided with a faceguard (e.g., a grid (a.k.a. "cage"), or visor) to protect at least part of a user's face, including his/her eyes. The faceguard may often be sold or otherwise provided separately from the helmet and then fastened to the helmet, such as at a retail store or other location selling or otherwise providing the helmet and/or the faceguard. This may sometimes be inefficient, impractical, and/or time-consuming, as fastening hardware has to be handled along with other components, different combinations of sizes may have to be assembled for the user's head, etc.

For these and other reasons, there is a need for improvements directed to facilitating provision of faceguards for helmets.

SUMMARY

According to various aspects, this disclosure relates to a helmet for protecting a user's head, in which fastening of a faceguard to the helmet is facilitated, such as by retention of fastening hardware (e.g., one or more fasteners) on the faceguard before the faceguard is fastened to the helmet. This may be useful for a user or other individuals, such as at a retail store or other location selling or otherwise providing the helmet and/or the faceguard.

For example, according to one aspect, this disclosure relates to a faceguard for a helmet. The faceguard comprises: a mount configured to mount the faceguard to the helmet; a fastener configured to fasten the faceguard to the helmet; and a retainer retaining the fastener and the mount together before the faceguard is fastened to the helmet.

According to another aspect, this disclosure relates to a faceguard for a helmet. The faceguard comprises: a mount configured to mount the faceguard to the helmet; a fastener configured to fasten the faceguard to the helmet; and a retainer retaining the fastener and the mount together before the faceguard is fastened to the helmet, the fastener being pushed through the retainer such that the retainer retains the fastener.

According to another aspect, this disclosure relates to a faceguard for a helmet. The faceguard comprises: a mount configured to mount the faceguard to the helmet; a fastener configured to fasten the faceguard to the helmet; and a retainer retaining the zo fastener and the mount together before the faceguard is fastened to the helmet, the retainer screwlessly retaining the fastener.

According to another aspect, this disclosure relates to a faceguard for a helmet. The faceguard comprises: a mount configured to mount the faceguard to the helmet; a fastener configured to fasten the faceguard to the helmet; and a retainer retaining the fastener and the mount together before the faceguard is fastened to the helmet, a thickness of the retainer being less than a length of the fastener.

According to another aspect, this disclosure relates to a faceguard for a helmet. The faceguard comprises: a mount configured to mount the faceguard to the helmet; a fastener configured to fasten the faceguard to the helmet; and a retainer retaining the fastener and the mount together before the faceguard is fastened to the helmet, the retainer being planar.

According to another aspect, this disclosure provides a system for fastening a faceguard to a helmet. The faceguard comprises a mount configured to mount the faceguard to the helmet. The system comprises: a fastener configured to fasten the faceguard to the helmet; and a retainer configured to retain the fastener and the mount together before the faceguard is fastened to the helmet.

According to another aspect, this disclosure relates to a faceguard for a helmet. The faceguard comprises: a mount configured to mount the faceguard to the helmet; a fastener configured to fasten the faceguard to the helmet; and a retainer retaining the fastener and the mount together before the faceguard is fastened to the helmet, the retainer being formed integrally with the mount.

According to another aspect, this disclosure relates to a faceguard for a helmet. The faceguard comprises: a mount configured to mount the faceguard to the helmet; a fastener configured to fasten the faceguard to the helmet; and a retainer retaining the fastener and the mount together before the faceguard is fastened to the helmet, the retainer being molded with the mount.

According to another aspect, this disclosure provides a method to facilitate fastening of a faceguard to a helmet. The face guard comprises a mount configured to mount the faceguard to the helmet. The method comprises: providing a fastener configured to fasten the faceguard to the helmet; and using a retainer to retain the fastener and the mount together before the faceguard is fastened to the helmet.

According to another aspect, this disclosure provides a method of fastening a faceguard to a helmet. The face guard comprises: a mount configured to mount the faceguard to the helmet; a fastener configured to fasten the faceguard to the helmet; and a retainer to retain the fastener and the mount together before the faceguard is fastened to the helmet. The method comprises: taking the helmet and the faceguard; and using the fastener to fasten the faceguard to the helmet while the retainer retains the fastener.

These and other aspects of this disclosure will now become apparent to those of ordinary skill upon review of a description of embodiments that follows in conjunction with accompanying drawings.

BRIEF DESCRIPTION OF DRAWINGS

A detailed description of embodiments is provided below, by way of example only, with reference to drawings accompanying this description, in which.

Figure 1:
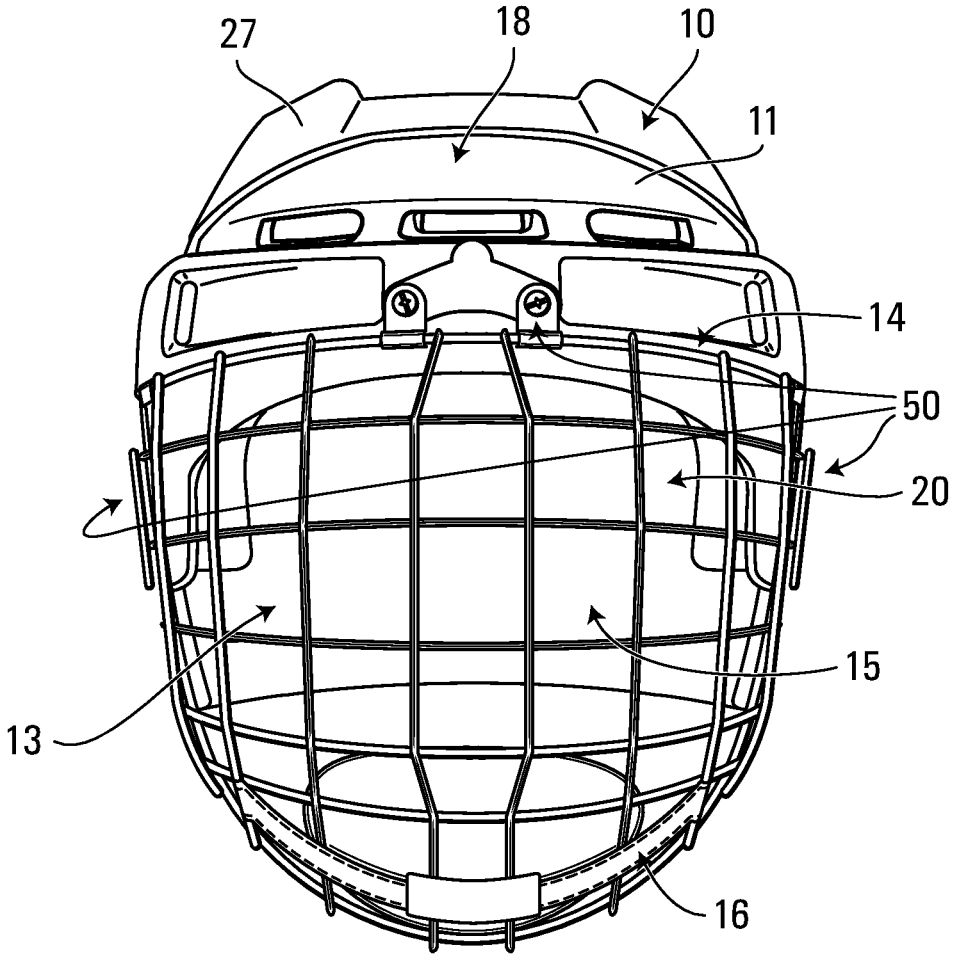
FIG. 1 shows an embodiment of a helmet for protecting a user's head, in which the helmet is provided with a faceguard.
Figure 2:
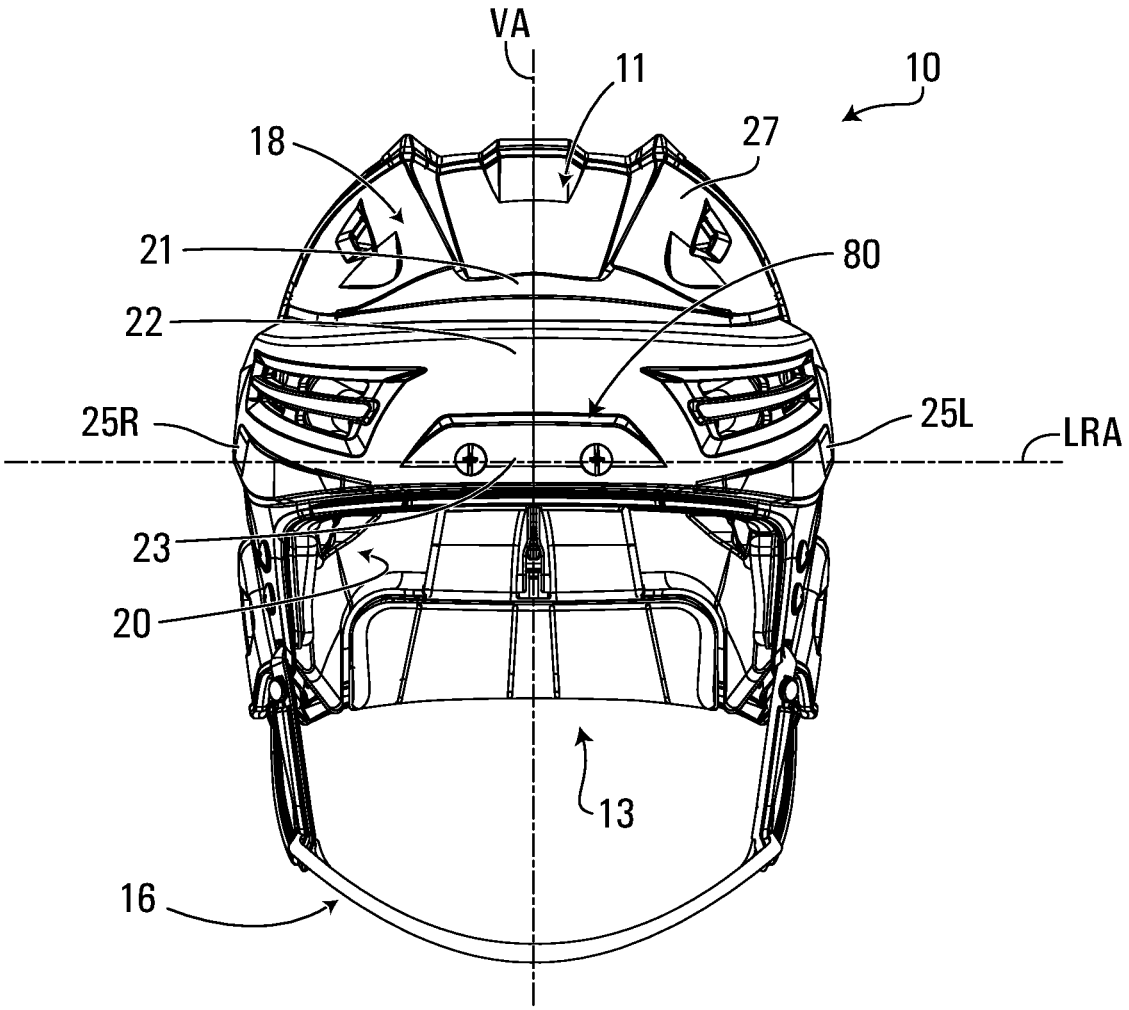
FIG. 2 shows a front view of the helmet.
Figure 3:
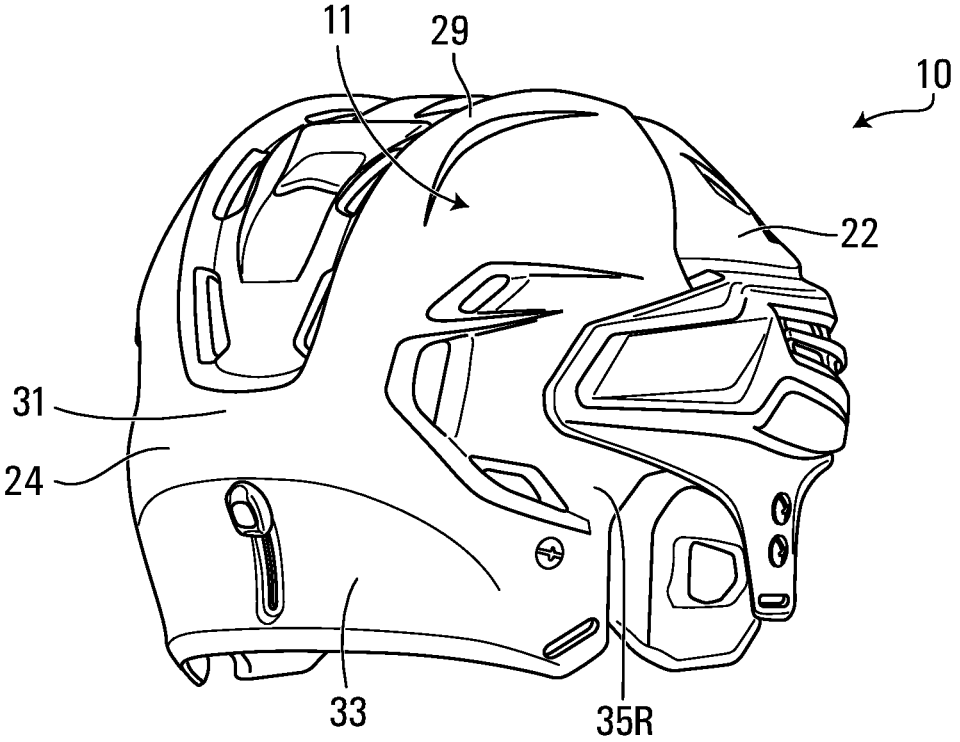
FIGS. 3 and 4 show rear perspective views of the helmet.
Figure 4:
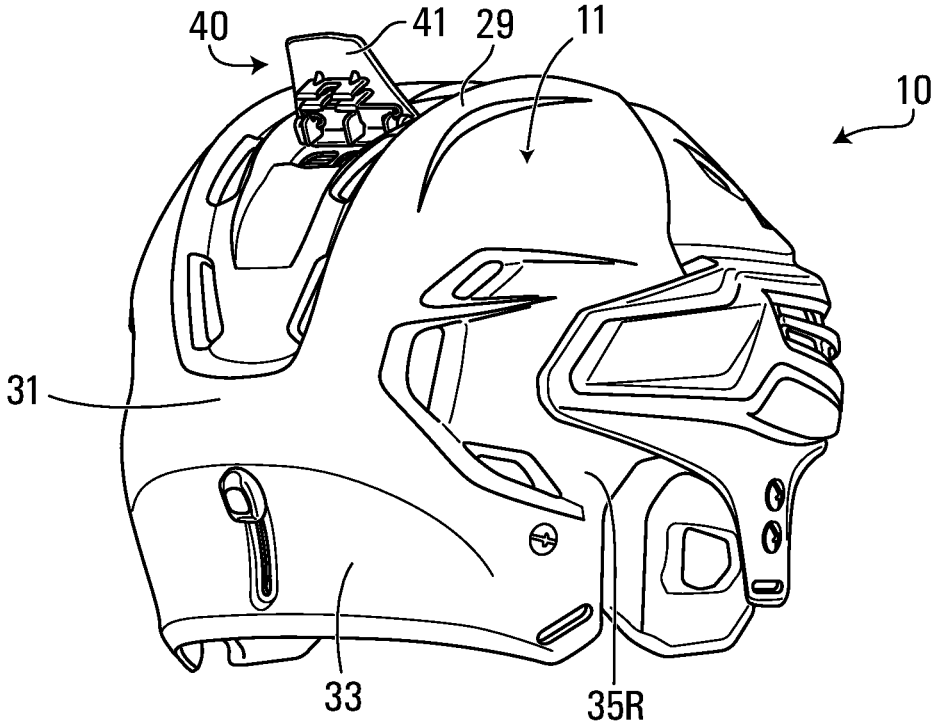

It is to be expressly understood that the description and drawings are only for purposes of illustrating certain embodiments and are an aid for understanding. They are not intended to be and should not be limiting.

DETAILED DESCRIPTION OF EMBODIMENTS

FIGS. 1 to 20 show an embodiment of a helmet 10 for protecting a user's head, in which the helmet 10 is provided with a faceguard 14. In this embodiment, the helmet 10 is an athletic helmet for protecting the head of the user who is engaging in a sport or other athletic activity against impacts. More particularly, in this embodiment, the helmet 10 is a hockey helmet for protecting the head of the user, who is a hockey player, against impacts (e.g., from a puck or ball, a hockey stick, a board, ice or another playing surface, etc., with another player, etc.).

As further discussed below, in this embodiment, fastening of the faceguard 14 to the helmet 10 is facilitated, including by retention of fastening hardware (e.g., one or more fasteners) on the faceguard 14 before the faceguard 14 is fastened to the helmet 10. This may be useful for the user or other individuals, such as at a retail store or other location selling or otherwise providing the helmet 10 and/or the faceguard 14.

The helmet 10 comprises an outer shell 11 and a liner 15 to protect the user's head. In this example, the helmet 10 also comprises a chinstrap 16 for securing the helmet 10 to the user's head.

Figure 40:
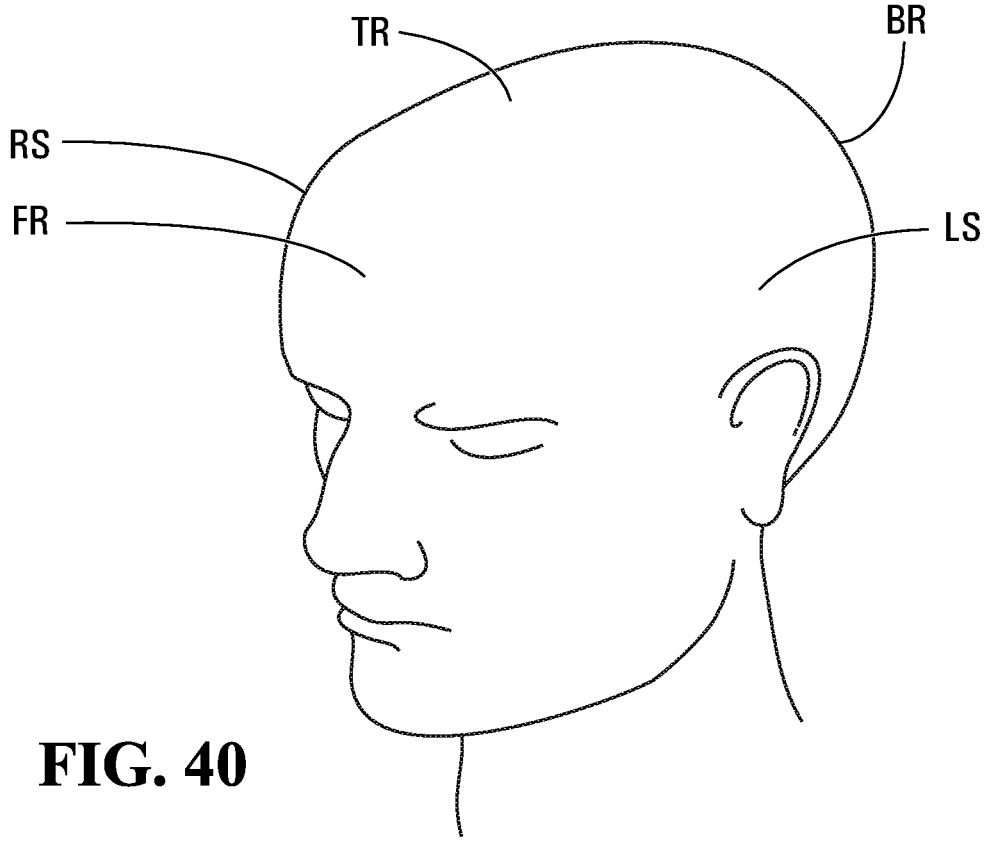
FIGS. 40 and 41 show a head of a user.
Figure 41:
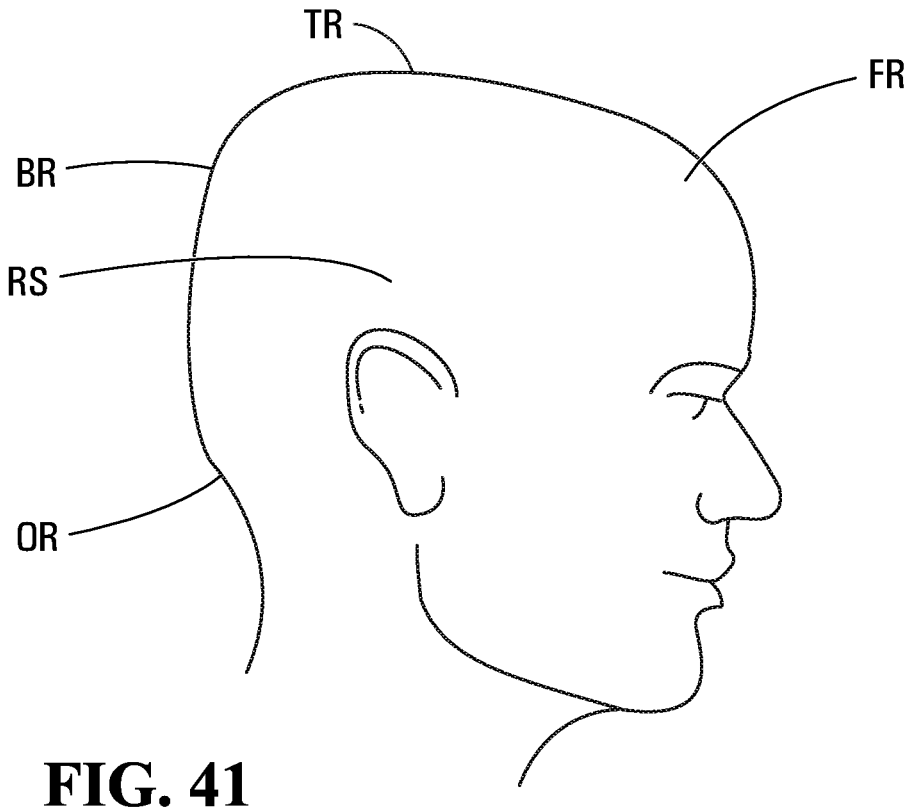

A cavity 13 of the helmet 10 is configured to receive the user's head. In response to an impact, the helmet 10 absorbs energy from the impact to protect the user's head. The helmet 10 protects various regions of the user's head. As shown in FIGS. 40 and 41, the user's head comprises a front region FR, a top region TR, left and right side regions LS, RS, a back region BR, and an occipital region OR. The front region FR includes a forehead and a front top part of the user's head and generally corresponds to a frontal bone region of the user's head. The left and right side regions LS, RS are approximately located above the user's ears. The back region BR is opposite the front region FR and includes a rear upper part of the user's head. The occipital region OR substantially corresponds to a region around and under the head's occipital protuberance.

The helmet 10 comprises an external surface 18 and an internal surface 20 that contacts the user's head when the helmet 10 is worn. The helmet 10 has a front-back axis FBA, a left-right axis LRA, and a vertical axis VA which are respectively generally parallel to a dorsoventral axis, a dextrosinistral axis, and a cephalocaudal axis of the user when the helmet 10 is worn and which respectively define a front-back direction, a lateral direction, and a vertical direction of the helmet 10. Since they are generally oriented longitudinally and transversally of the helmet 10, the front-back axis FBA and the left-right axis LRA can also be referred to as a longitudinal axis and a transversal axis, respectively, while the front-back direction and the lateral direction can also be referred to a longitudinal direction and a transversal direction, respectfully.

The outer shell 11 provides strength and rigidity to the helmet 10. To that end, the outer shell 11 typically comprises a rigid material 27. For example, in various embodiments, the rigid material 27 of the outer shell 11 may be a thermoplastic material such as polyethylene (PE), polyamide (nylon), or polycarbonate, a thermosetting resin, or any other suitable material. The outer shell 11 includes an inner surface 17 facing the inner liner 15 and an outer surface 19 opposite the inner surface 17. The outer surface 19 of the outer shell 11 constitutes at least part of the external surface 18 of the helmet 10.

In this embodiment, the outer shell 11 comprises shell members 22, 24 that are connected to one another. In this example, the shell member 22 comprises a top portion 21 for facing at least part of the top region TR of the user's head, a front portion 23 for facing at least part of the front region FR of the user's head, and left and right lateral side portions 25L, 25R extending rearwardly from the front portion 23 for facing at least part of the left and right side regions LS, RS of the user's head, respectively. The shell member 24 comprises a top portion 29 for facing at least part of the top region TR of the user's head, a back portion 31 for facing at least part of the back region BR of the user's head, an occipital portion 33 for facing at least part of the occipital region OR of the user's head, and left and right lateral side portions 35L, 35R extending forwardly from the back portion 31 for facing at least part of the left and right side regions LS, RS of the user's head, respectively.

Figure 42:
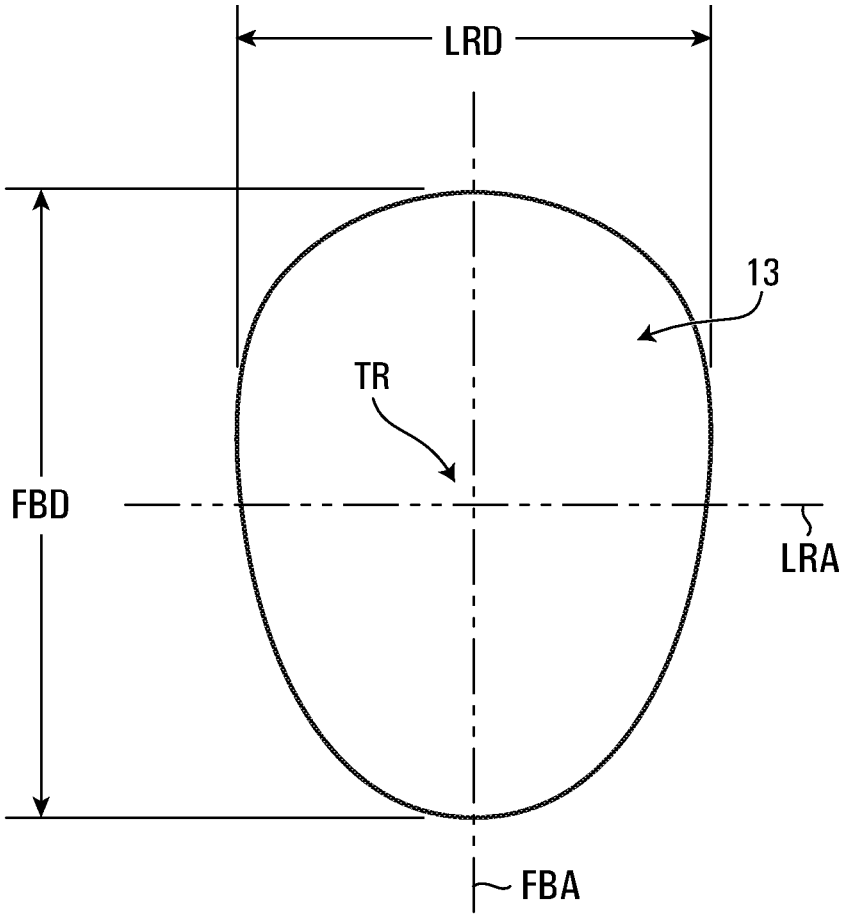
FIG. 42 shows internal dimensions of a head-receiving cavity of the helmet.

In this embodiment, the helmet 10 is adjustable to adjust how it fits on the user's head. To that end, the helmet 10 comprises an adjustment mechanism 40 for adjusting a fit of the helmet 10 on the user's head. The adjustment mechanism 40 may allow the fit of the helmet 10 to be adjusted by adjusting one or more internal dimensions of the cavity 13 of the helmet 10, such as a front-back internal dimension FBD of the cavity 13 in the front-back direction of the helmet 10 and/or a left-right internal dimension LRD of the cavity 13 in the left-right direction of the helmet 10, as shown in FIG. 42.

Figure 5:
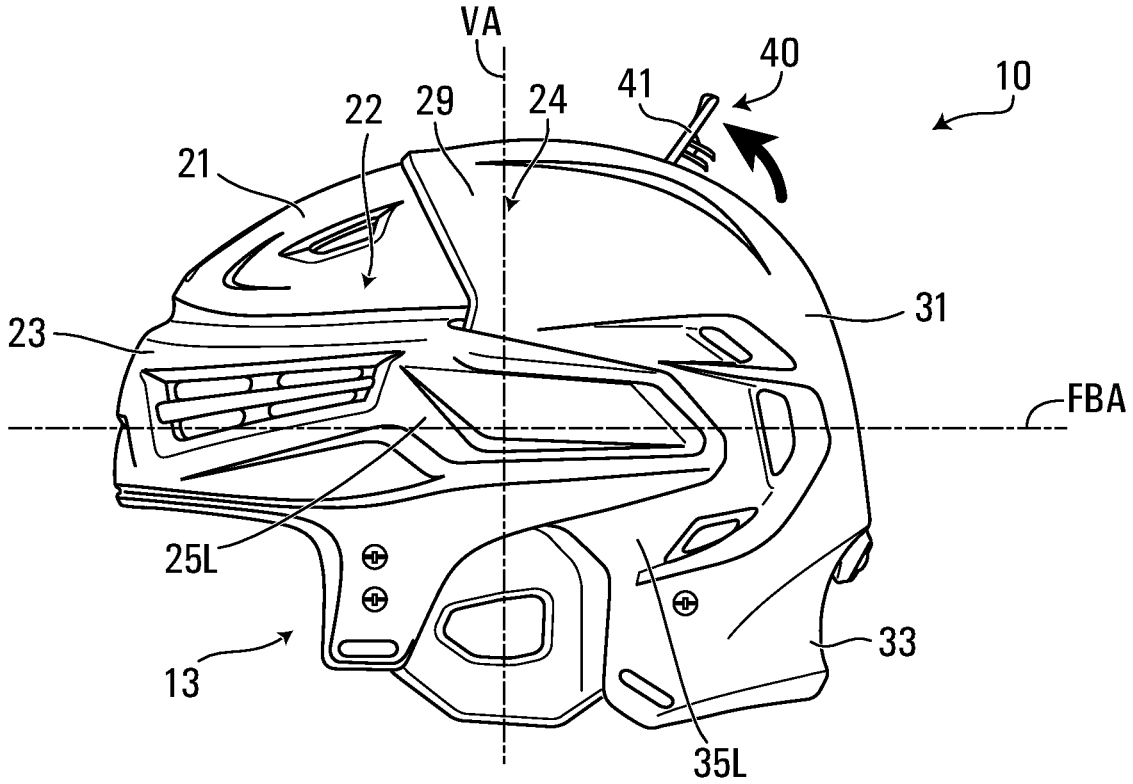
FIGS. 5 to 8 show an adjustment mechanism of the helmet.
Figure 6:
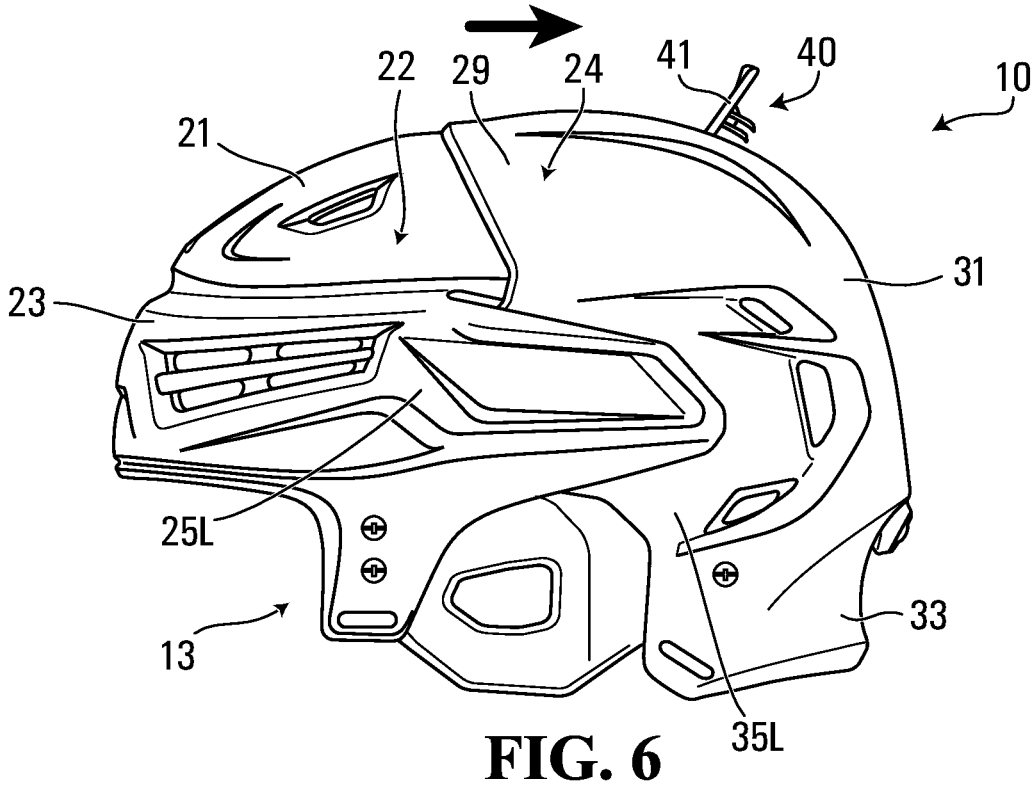
Figure 7:
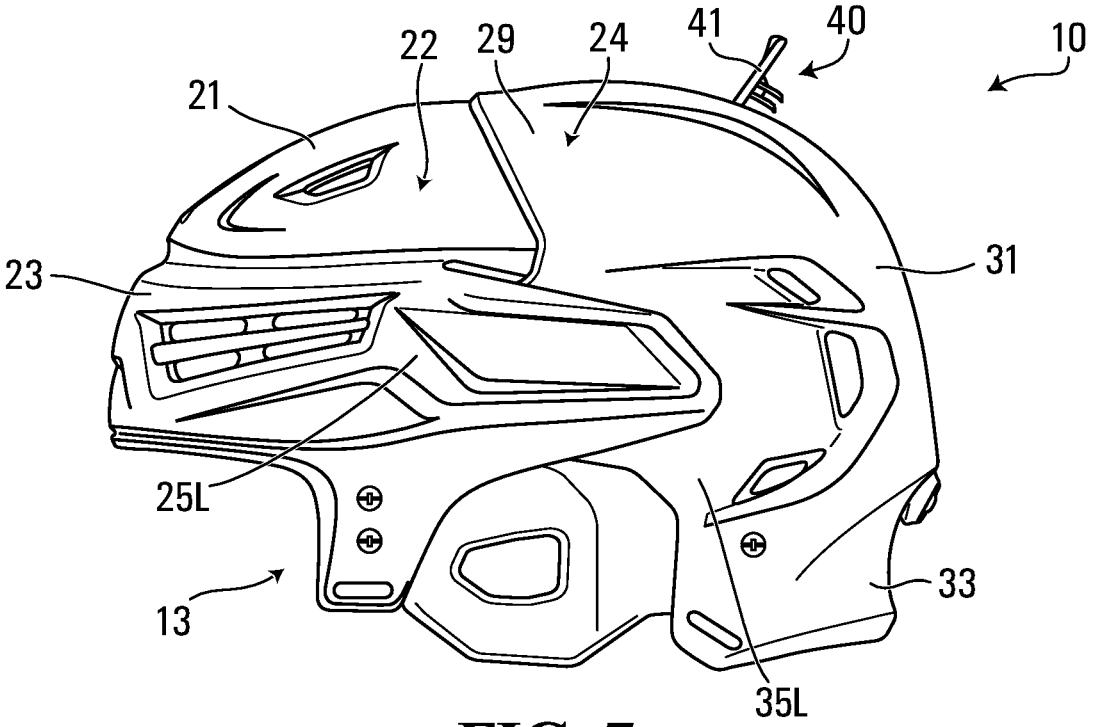
Figure 8:
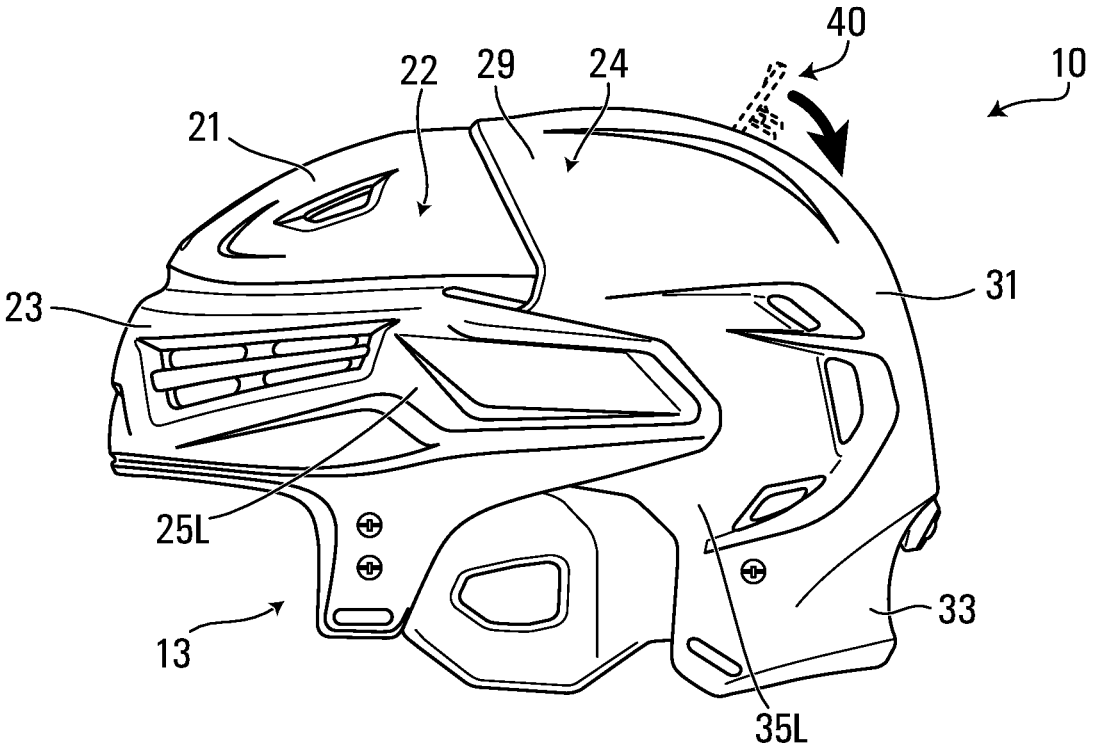

More particularly, in this embodiment, the adjustment mechanism 40 is configured such that the outer shell 11 and the liner 15 are adjustable to adjust the fit of the helmet 10 on the user's head. To that end, in this embodiment, the shell members 22, 24 are movable relative to one another to adjust the fit of the helmet 10 on the user's head. In this example, relative movement of the shell members 22, 24 for adjustment purposes is in the front-back direction of the helmet 10 such that the front-back internal dimension FBD of the cavity 13 of the helmet 10 is adjusted. This is shown in FIGS. 5 to 8 in which the shell member 24 is moved relative to the shell member 22 from a first position, which is shown in FIG. 5 and which corresponds to a minimum size of the helmet 10, to a second position, which is shown in FIG. 6 and which corresponds to an intermediate size of the helmet 10, and to a third position, which is shown in FIGS. 7 and 8 which corresponds to a maximum size of the helmet 10.

Figure 9:
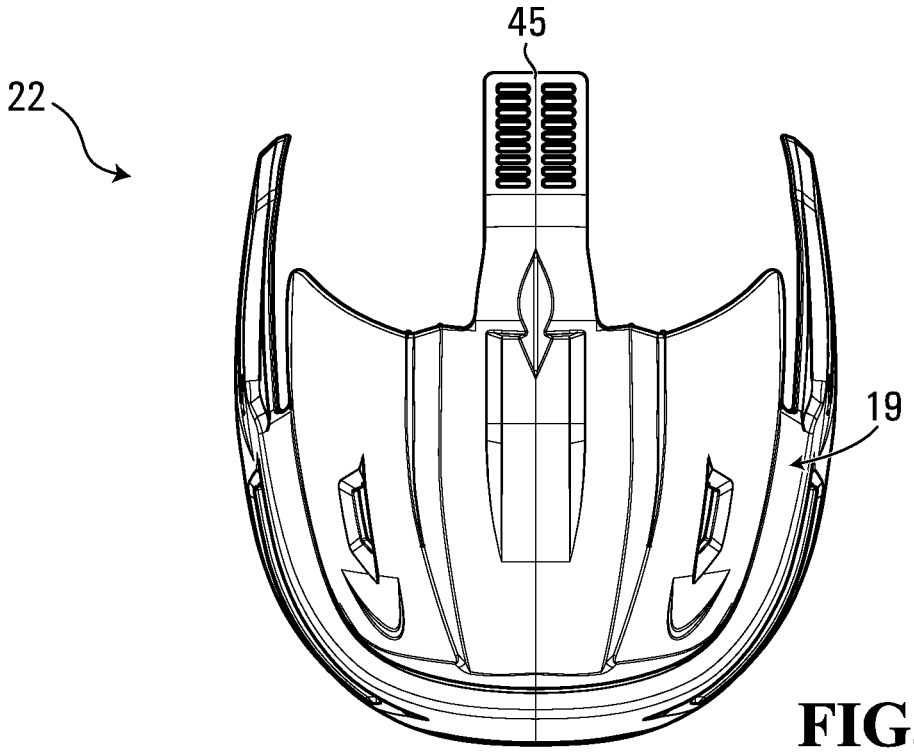
FIGS. 9 and 10 show an example of shell members of an outer shell of the helmet.
Figure 10:
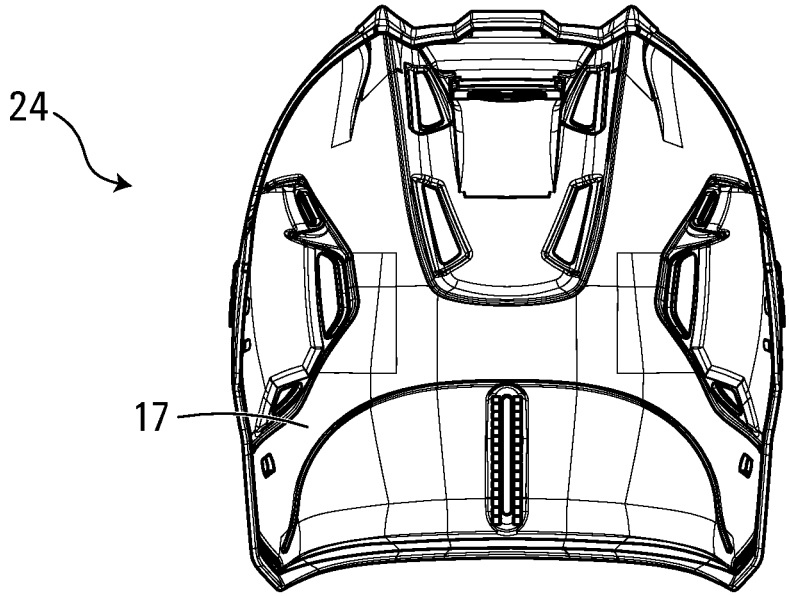
Figure 11:
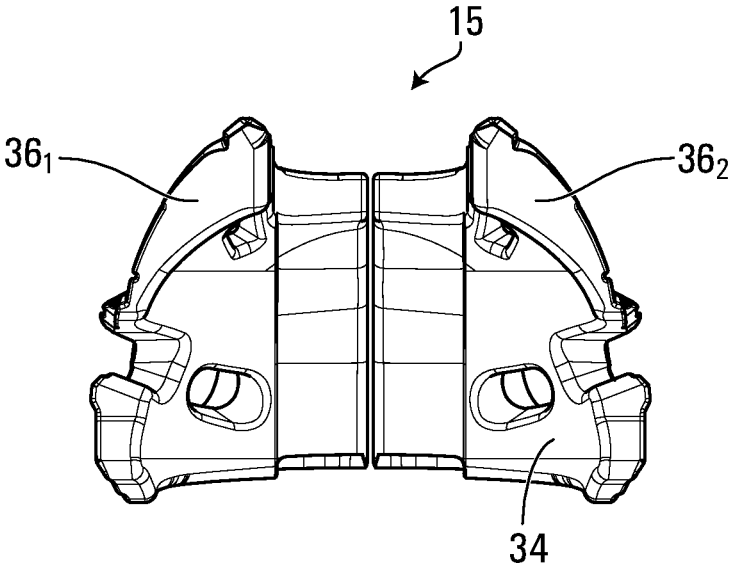
FIGS. 11 to 14 show pads of a liner of the helmet.
Figure 12:
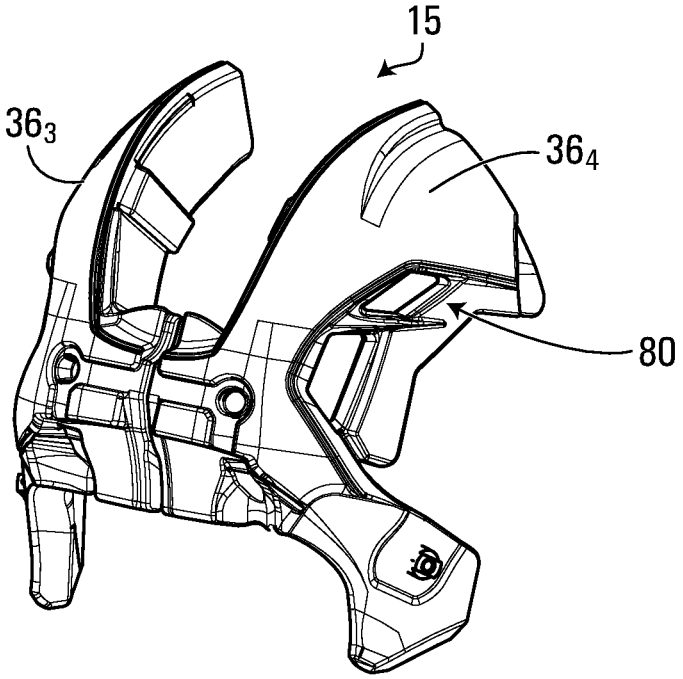
Figure 13:
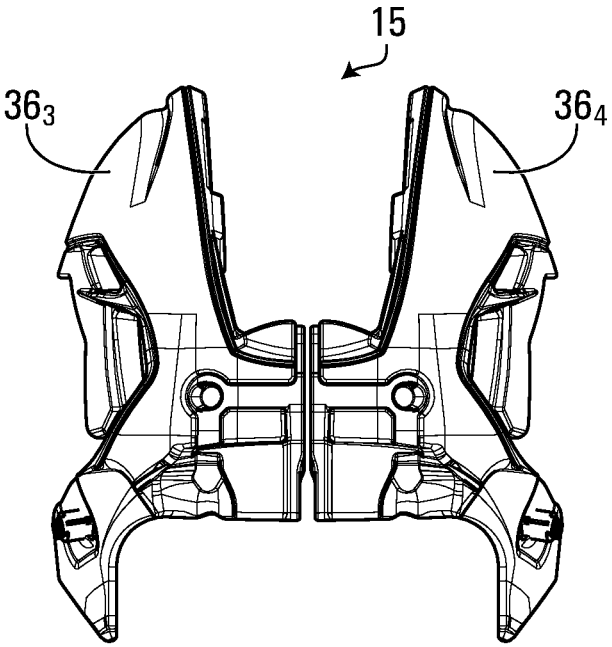
Figure 14:
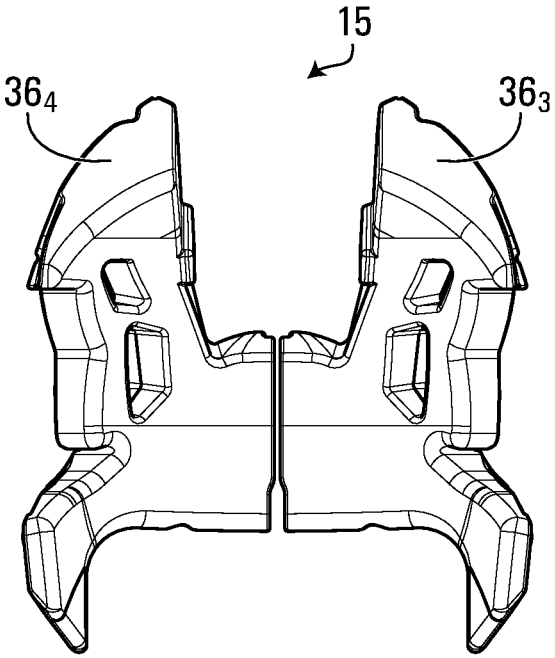
Figure 15:
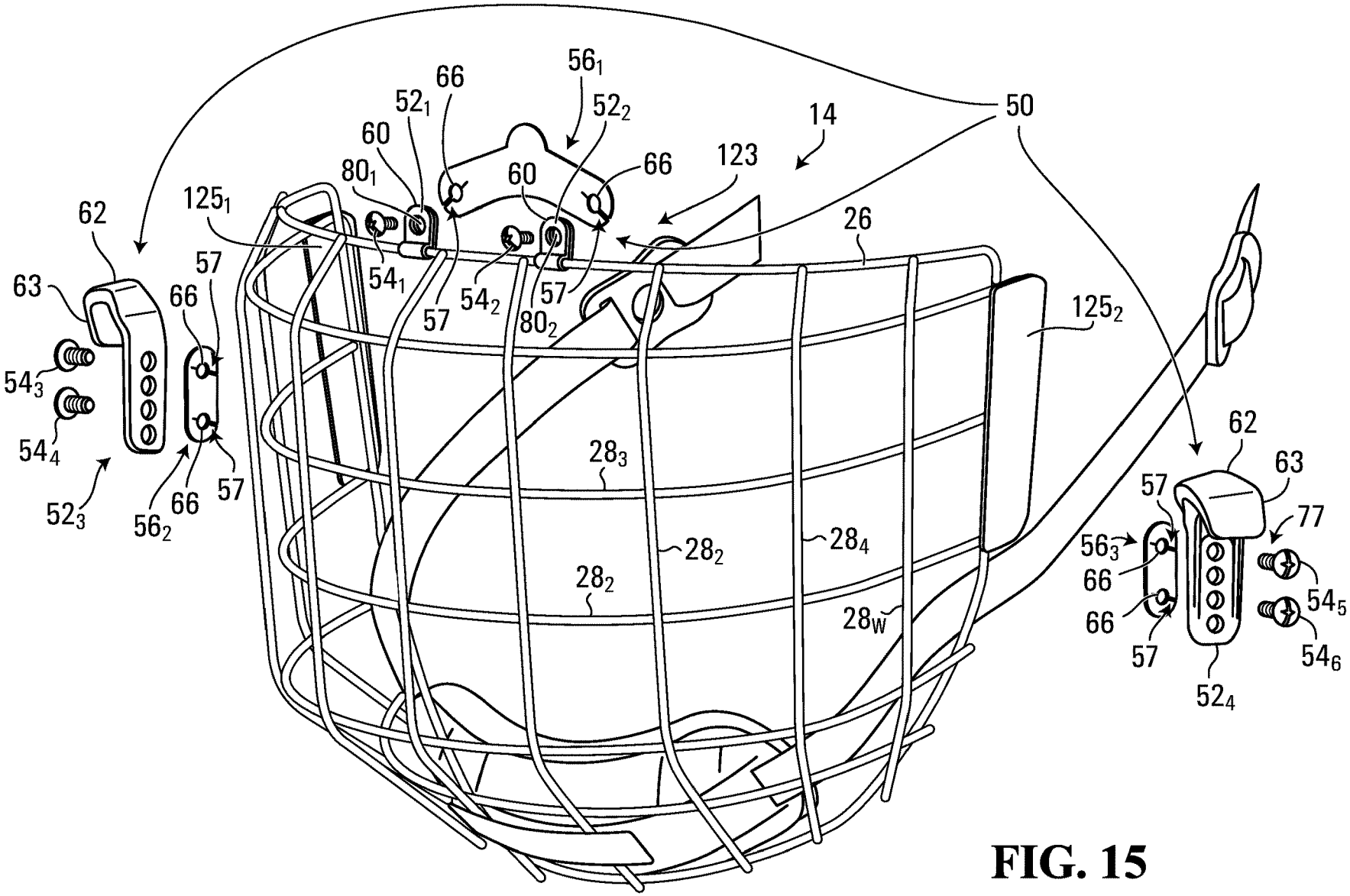
FIGS. 15 shows an exploded view of the faceguard comprising a fastening system to fasten the face guard to the helmet.
Figure 16:
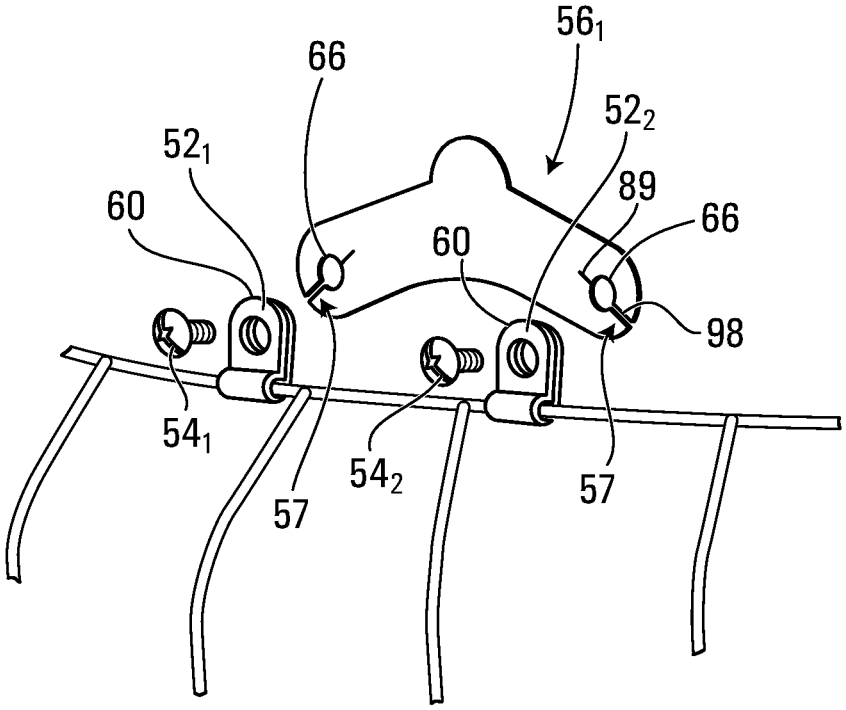
FIGS. 16 and 17 show an exploded view of a front portion of the fastening system of the faceguard.
Figure 17:
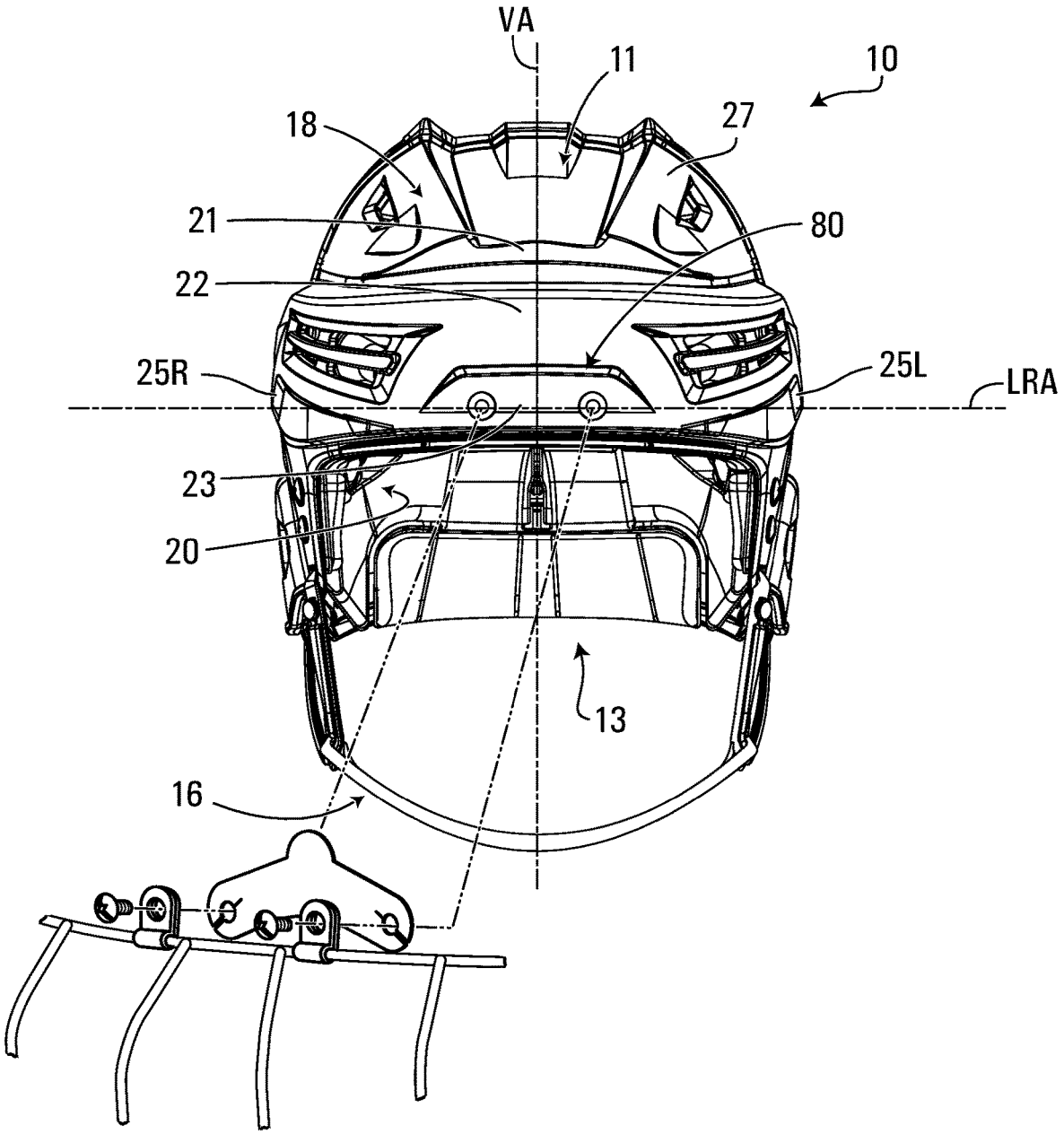
Figure 18:
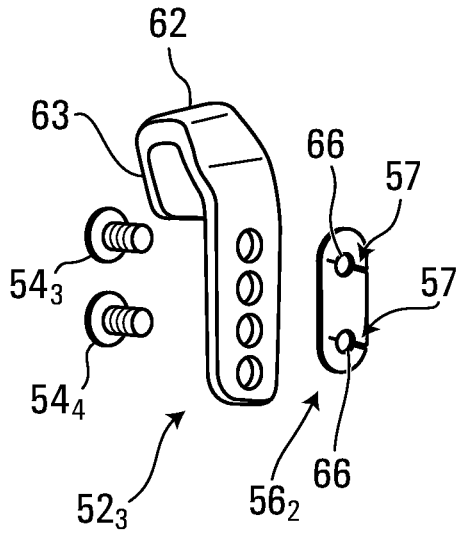
FIG. 18 shows an exploded view of a right portion of the fastening system of the faceguard.
Figure 19:
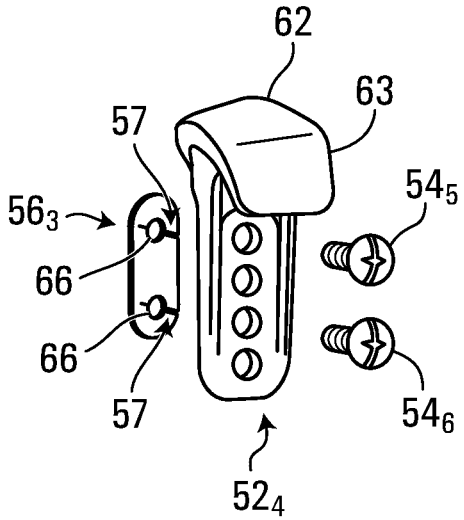
FIG. 19 shows an exploded view of a left portion of the fastening system of the faceguard.
Figure 20:
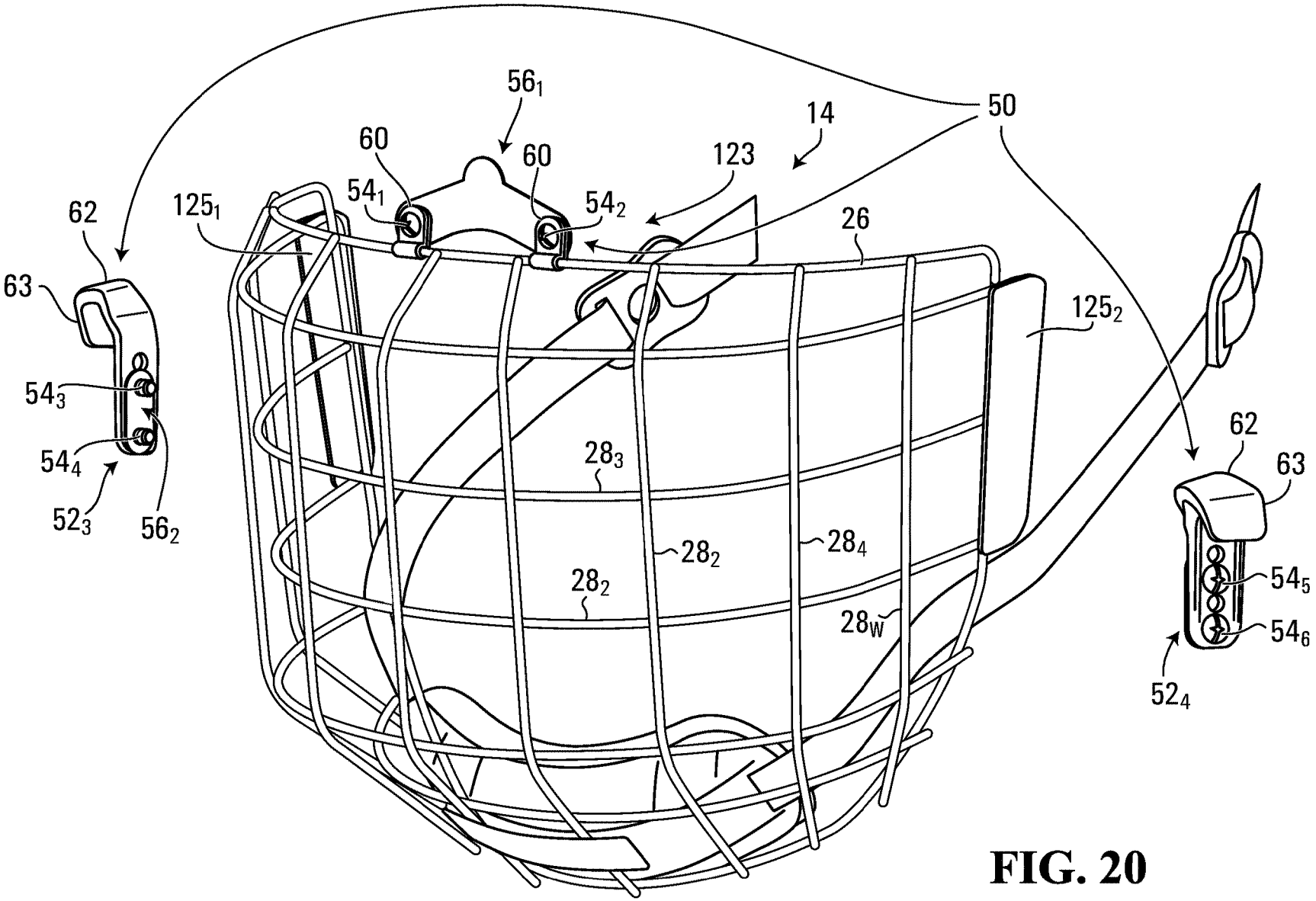
FIG. 20 shows an assembled view of the faceguard.
Figure 21:
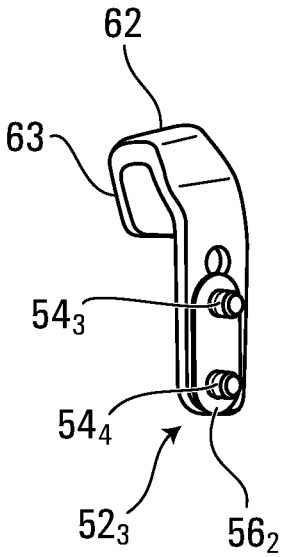
FIG. 21 shows an assembled view of the right portion of the fastening system.
Figure 22:
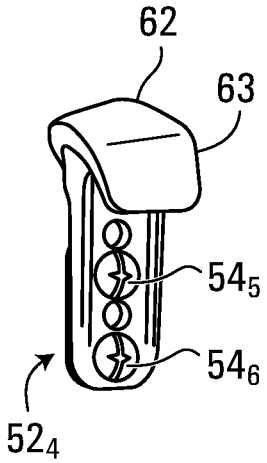
FIG. 22 shows an assembled view of the left portion of the fastening system.
Figure 23:
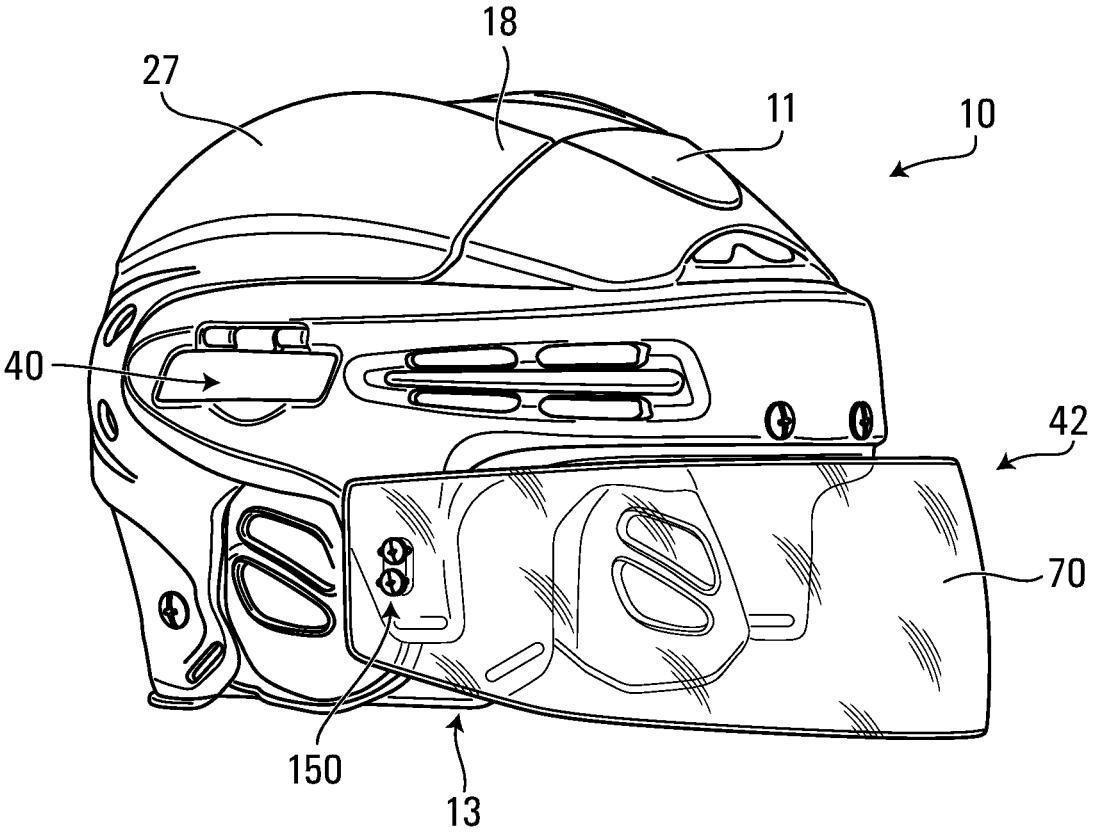
FIG. 23 shows an example of a variant of the helmet wherein the faceguard comprises a visor.
Figure 24:
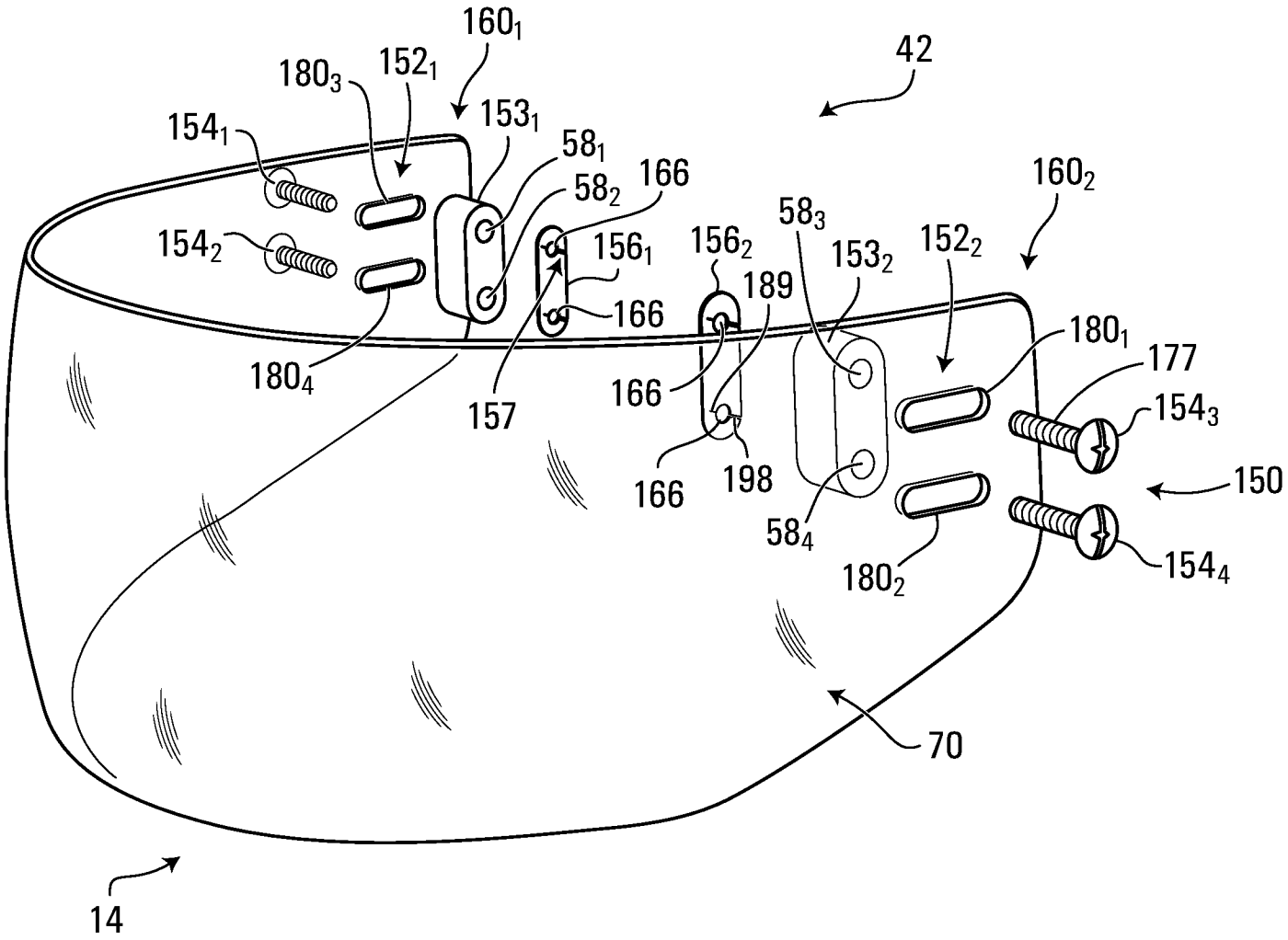
FIG. 24 shows an exploded view of a variant of the fastening system of the faceguard.
Figure 25:
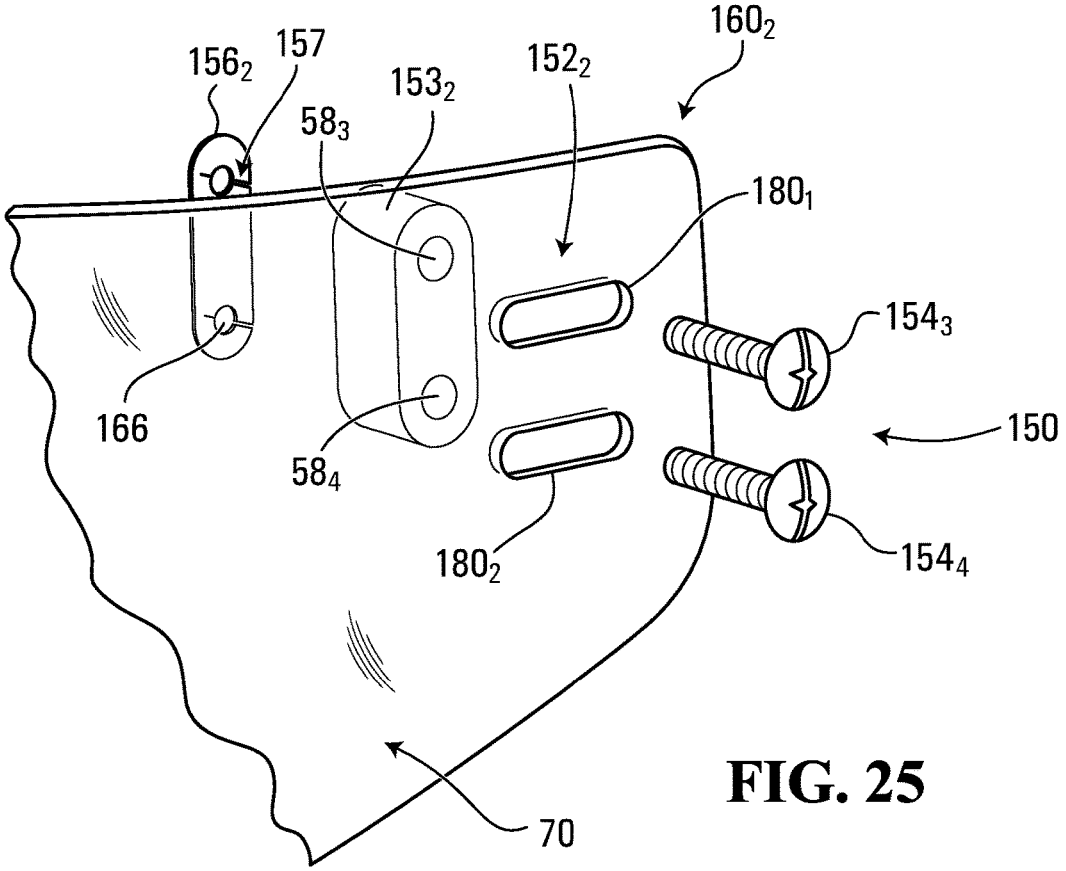
FIG. 25 shows an exploded view of the left portion of the fastening system of the faceguard.
Figure 26:
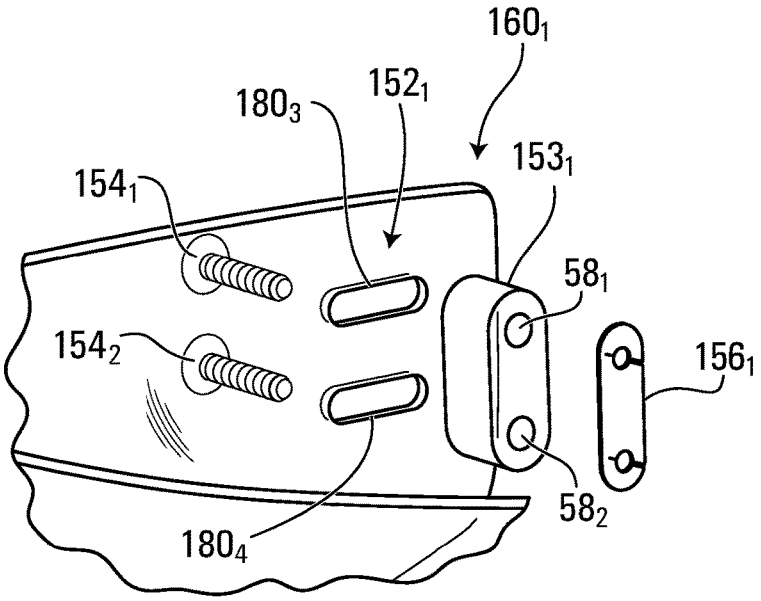
FIG. 26 shows an exploded view the right portion of the fastening system of the faceguard.
Figure 27:
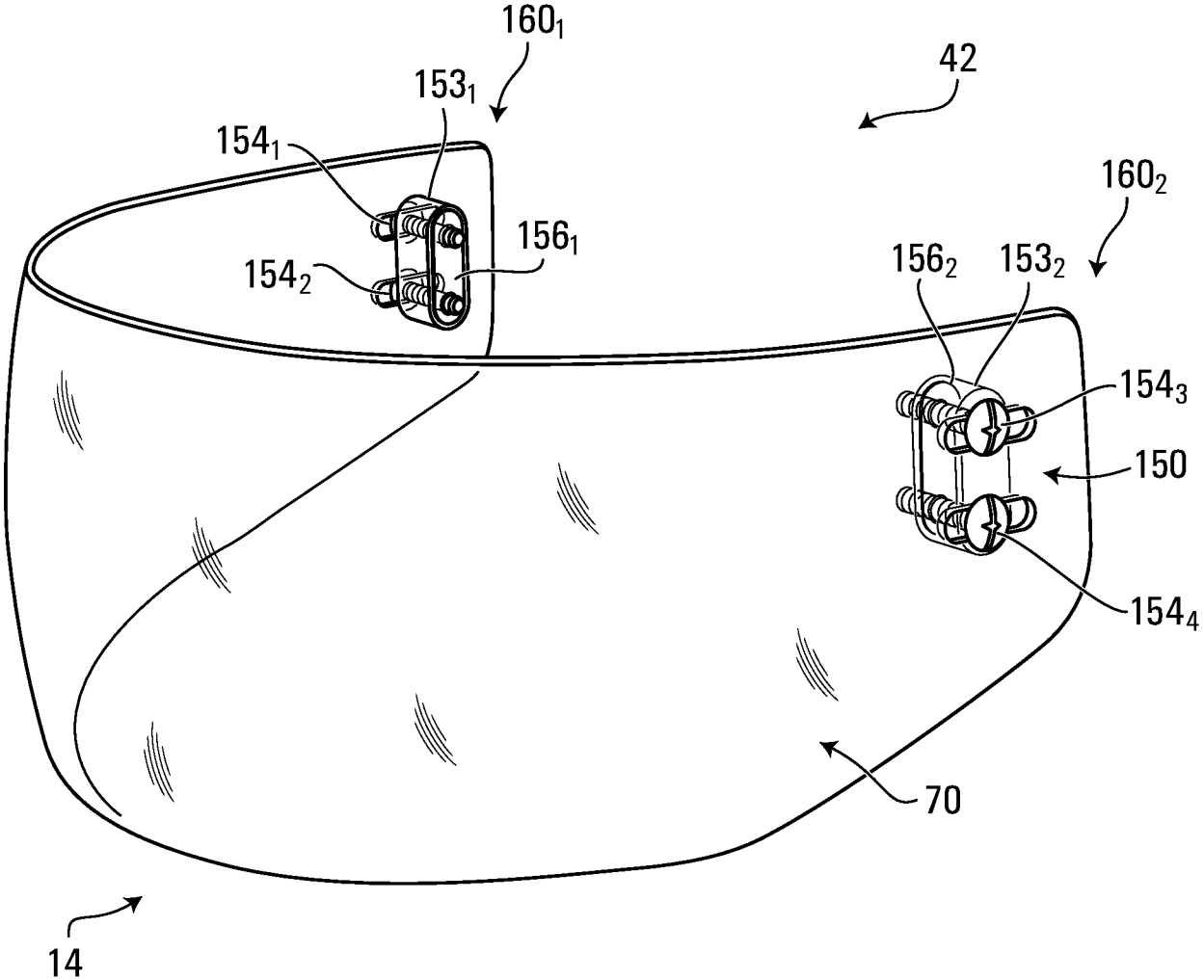
FIG. 27 shows an assembled view of the faceguard.
Figure 28:
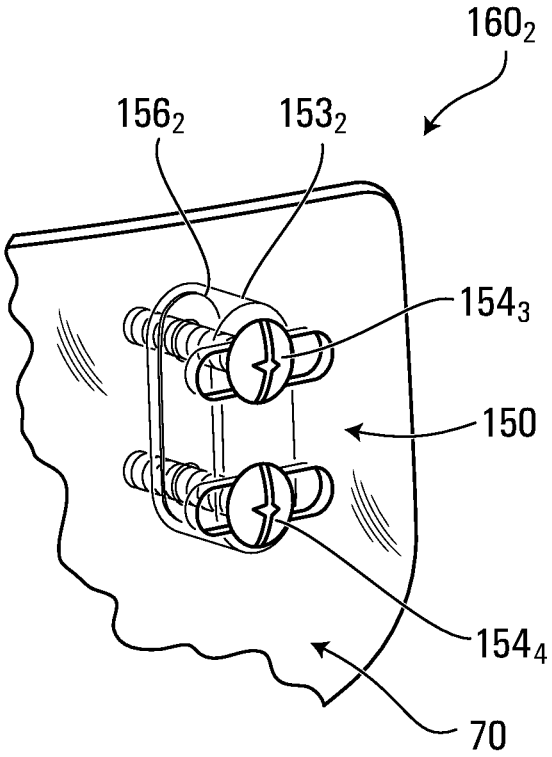
FIG. 28 shows an assembled view of the left portion of the fastening system of the faceguard.
Figure 29:
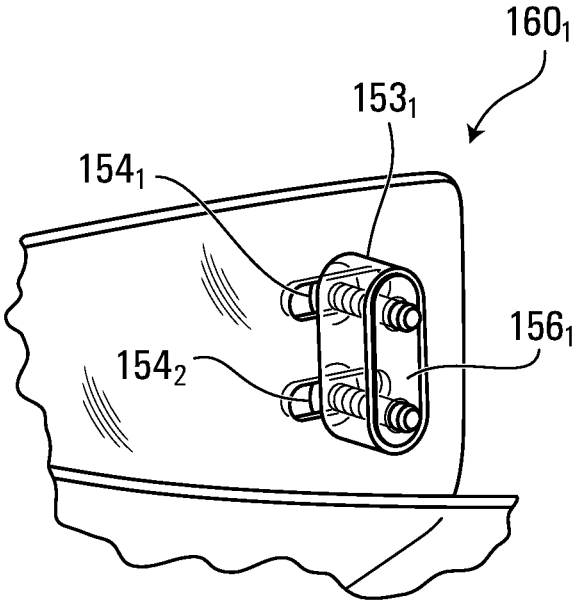
FIG. 29 shows an assembled view of the right portion of he fastening system of the faceguard.

In this example of implementation, the adjustment mechanism 40 comprises an actuator 41 that can be moved (in this case pivoted) by the user between a locked position, in which the actuator 41 engages a locking part 45 (as best shown in FIGS. 9 and 10) of the shell member 22 and thereby locks the shell members 22, 24 relative to one another, and a release position, in which the actuator 41 is disengaged from the locking part 45 of the shell member 22 and thereby permits the shell members 22, 24 to move relative to one another so as to adjust the size of the helmet 10. The adjustment mechanism 40 may be implemented in any other suitably way in other embodiments.

The liner 15 is disposed within the outer shell 11, i.e., between the outer shell 11 and the user's head when the helmet 10 is worn. More particularly, the liner 15 comprises shock-absorbing material. For instance, in some cases, the shock-absorbing material may include a polymeric foam (e.g., expanded polypropylene (EPP) foam, expanded polyethylene (EPE) foam, expanded polymeric microspheres (e.g., Expancel™ microspheres commercialized by Nouryon), or any other suitable polymeric foam material) and/or a polymeric structure comprising one or more polymeric materials. Any other material with suitable impact energy absorption may be used in other embodiments. Additionally or alternatively, in some embodiments, the liner 15 may comprise an array of shock absorbers that are configured to deform when the helmet 10 is impacted. For instance, in some cases, the array of shock absorbers may include an array of compressible cells that can compress when the helmet 10 is impacted. Examples of this are described in U.S. Pat. No. 7,677,538 and U.S. Patent Application Publication 2010/0258988, which are incorporated by reference herein.

The liner 15 may be connected to the outer shell 11 in any suitable way. For example, in some embodiments, the inner liner 15 may be fastened to the outer shell 11 by one or more fasteners such as mechanical fasteners (e.g., tacks, staples, rivets, screws, stitches, eta), an adhesive, or any other suitable fastener.

In this embodiment, the liner 15 comprises a plurality of pads $\mathbf{36}_1$-$\mathbf{36}_A$ disposed between the outer shell 11 and the user's head when the helmet 10 is worn. In this example, respective ones of the pads $\mathbf{36}_1$-$\mathbf{36}_A$ are movable relative to one another and with the shell members 22, 24 to allow adjustment of the fit of the helmet 10 using the adjustment mechanism 40.

More particularly, in this embodiment, the pad $\mathbf{36}_1$ is for facing at least part of the front region FR and left side region LS of the user's head, the pad $\mathbf{36}_2$ is for facing at least part of the front region FR and right side region RS of the user's head, the pad $\mathbf{36}_3$ is for facing at least part of the back region BR and left side region LS of the user's head, the pad $\mathbf{36}_4$ is for facing at least part of the back region BR and right side region RS of the user's head. Another pad, (not shown in FIGS. 11 to 14) is for facing at least part of the top region TR and back region BR of the user's head. The shell member 22 overlays the pads $\mathbf{36}_1$, $\mathbf{36}_2$ while the shell member 24 overlays the pads $\mathbf{36}_3$, $\mathbf{36}_4$.

In this example, respective ones of the pads $\mathbf{36}_1$-$\mathbf{36}_A$ are responsible for absorbing at least a bulk of the impact energy transmitted to the inner liner 15 when the helmet 10 is impacted and can therefore be referred to as "absorption" pads, while other ones of the pads $\mathbf{36}_1$-$\mathbf{36}_A$ are responsible to provide comfort to the user's head and can therefore be referred to as "comfort" pads. In some cases, one or more of these comfort pads may be secured (e.g., adhered, fastened, etc.) to these absorption pads. In other cases, one or more of these comfort pads may be mounted such that they are movable relative to one or more of these absorption pads. For example, in some embodiments, one or more of these comfort pads may be part of a floating liner as described in U.S. Patent Application Publication 2013/0025032. These comfort pads may assist in absorption of energy from impacts, in particular, low-energy impacts.

The faceguard 14 is configured to protect at least part of the user's face, including eyes of the user. That is, the faceguard 14 may protect an entirety of the user's face, in which case it may be referred to as providing "full-face" protection, or may protect less than the entirety (e.g., half or some other fraction) of the user's face, in which case it may be referred to as providing "half-face" or "partial-face" protection.

In this embodiment, the faceguard 14 comprises a grid 26, sometimes referred to as a "cage", which includes a plurality of wires $\mathbf{28}_1$-$\mathbf{28}_W$ intersecting one another. The wires $\mathbf{28}_1$-$\mathbf{28}_W$ may be metallic (e.g., made of steel, titanium and/or other suitable metal), Respective ones of the wires $\mathbf{28}_1$-$\mathbf{28}_W$ may be connected to one another by welding, by integrally forming (e.g., casting, additively-manufacturing, etc.) them together, and/or by any other means.

In this embodiment, a fastening system 50 is configured to fasten the faceguard 14 to the helmet 10. In this embodiment, the fastening system 50 comprises mounts $\mathbf{52}_1$-$\mathbf{52}_4$ configured to mount the faceguard 14 to the helmet 10, fasteners $\mathbf{54}_1$-$\mathbf{54}_6$ configured to fasten the faceguard 14 to the helmet 10 via the mounts $\mathbf{52}_1$-$\mathbf{52}_4$, and retainers $\mathbf{56}_1$-$\mathbf{56}_3$ configured to retain given ones of the fasteners $\mathbf{54}_1$-$\mathbf{54}_6$ and respective ones of the mounts $\mathbf{52}_1$-$\mathbf{52}_4$ together before the faceguard 14 is fastened to the helmet 10. The retainers $\mathbf{56}_1$-$\mathbf{56}_3$ therefore facilitate assembly of the faceguard 14 and the helmet 10 by holding the fasteners $\mathbf{54}_1$-$\mathbf{54}_6$ onto the mounts $\mathbf{52}_1$-$\mathbf{52}_4$ of the faceguard 14 at least until the faceguard 14 is fastened to the helmet 10, which may make this assembly more efficient, more practical, and/or less time-consuming.

In this example of implementation, the mounts $52_1$, $52_2$ are front mounts configured to mount a front portion 123 of the faceguard 14 to a front portion 23 of the helmet 10, whereas the mounts $52_3$, $52_4$ are lateral mounts configured to mount lateral portions $125_1$, $125_2$ of the faceguard 14 that are opposite one another to lateral portions 25L, 25R of the helmet 10 that are opposite one another. In this case, each of the front mounts $52_1$, $52_2$ includes a front clip 60 that is secured to a top one of the wires $28_1$-$28_W$ of the grid 26, while each of the lateral mounts $52_3$, $52_4$ comprises a J-clip 62 fastenable to the helmet 10 and including a hook 63 to engage the top one of the wires $28_1$-$28_W$ of the grid 26 adjacent to the lateral portions $125_2$, $125_1$ of the faceguard 14. In this example, each of the mounts $52_1$-$52_4$ comprises at least one opening 80 to receive at least one of the fasteners $54_1$-$54_6$ allowing for the faceguard 14 to be fastened to the helmet 10.

In this embodiment, the retainer $56_1$ is configured to retain the fastener $54_1$ and the front clip 60 of the front mount $52_1$ together before the faceguard 14 is fastened to the helmet 10 and retain the fastener $54_2$ and the front clip 60 of the front mount $52_2$ together before the faceguard 14 is fastened to the helmet 10. Also, the retainer $56_2$ is configured to retain the fasteners $54_3$, $54_4$ and the J-clip 62 of the lateral mount $52_3$ together before the faceguard 14 is fastened to the helmet 10, whereas the retainer $56_3$ is configured to retain the fasteners $54_6$, $54_6$ and the J-clip 62 of the lateral mount $52_4$ together before the faceguard 14 is fastened to the helmet 10.

Each of the retainers $56_1$-$56_3$, which will be designated "$56_x$", may be implemented in any suitable way.

In this embodiment, the retainer $56_x$ is configured to retain a given one of the fasteners $54_1$-$54_6$, which is designated "$54_y$", by pushing the fastener $54_y$ through the retainer $56_x$. Thus, the retainer $56_x$ may screwlessly retain the fastener $54_y$, i.e., retains the fastener $54_y$ without screwing the fastener $54_y$ into the retainer $56_x$.

In this embodiment, the retainer $56_x$ is planar. In this example, the retainer $56_x$ is a plate. This may help to reduce noticeability and/or weight of the retainer $56_x$ (e.g., if it remains on the helmet 10 once the faceguard 14 is fastened to the helmet 10). The retainer $56_x$ is clear, which may also contribute to making it less noticeable. In this example, the retainer $56_x$ comprises a polymeric material. For instance, the polymeric material of the retainer $56_x$ may include at least one of polyethylene, polycarbonate and acrylic, or any other suitable material.

In this example of implementation, a thickness of the retainer $56_x$ is less than a length of a given one of the fastener $54_1$-$54_6$ that it receives. For instance, in some embodiments, the thickness of the retainer $56_x$ may be no more than 1.5 mm, in some cases no more than 1.3 mm, and in some cases no more than 1 mm.

In some embodiments, the retainer $56_x$ is configured such that one or more openings of the grid 26 is larger than the retainer $56_x$ such that the retainer is able to pass through the one or more openings of the grid 26. For instance, with reference to FIG. 15, each of at least two of the openings of the grid 26 is larger than the retainer $56_x$ such that the retainer $56_x$ is able to pass through each of the at least two of the openings of the grid 26.

In this embodiment, the retainer $56_x$ comprises at least one opening 66 to receive at least one of the fasteners $54_1$-$54_6$ that it retains. More particularly, in this embodiment, a given ones of the fasteners $54_1$-$54_6$ can be pushed through the opening 66 of the retainer $56_x$ and retained therein by being pushed therethrough. In this example, the opening 66 of the retainer $56_x$ is threadless. Also, in this case, each of the fasteners $54_1$-$54_6$ is threaded, i.e., includes a thread 77, and a diameter of the opening 66 of the retainer $56_x$ is less than an outer diameter of the thread 77 of the given one of the fasteners $54_1$-$54_6$ that it receives. This facilitates retention. Furthermore, in this example, the retainer $56_x$ comprises a fastener-insertion-facilitating split 89 spaced from a periphery of the retainer $56_x$ and contiguous to the opening 66 of the retainer $56_x$ in order to facilitate pushing of the given one of the fasteners $54_1$-$54_6$ into the opening 66 of the retainer $56_x$. In this case, the fasteners $54_1$-$54_6$ are screws. Also, in this case, the fastener-insertion-facilitating split 89 is a slit.

In some cases, the retainer $56_x$ may be removable from the faceguard 14. This allows the retainer $56_x$ to be removed from the faceguard 14 once the faceguard 14 is fastened to the helmet 10 (e.g., to avoid keeping the retainer $56_x$ on the helmet 14, reduce weight in use, etc.). For example, in this embodiment, the retainer $56_x$ comprises, for each of its at least one opening 66, a line of weakness 57 configured to facilitate removal of the retainer 56, from the faceguard 14. In this example, the line of weakness 57 of the retainer $56_x$ comprises a retainer-removal-facilitating split 98 which extends to the periphery of the retainer $56_x$ In this embodiment, the retainer-removal-facilitating split 98 of the retainer $56_x$ is wider than the fastener-insertion-facilitating split 89 of the retainer $56_x$. Alternatively, in some cases, the retainer-removal-facilitating split 98 of the retainer $56_x$ may be as wide as the fastener-insertion-facilitating split 89 of the retainer $56_x$ (e.g., if they are cut together). In other embodiments, the retainer $56_x$ may be permanent on the faceguard 14 (e.g., the retainer-removal-facilitating split 98 may be omitted).

Figure 32:
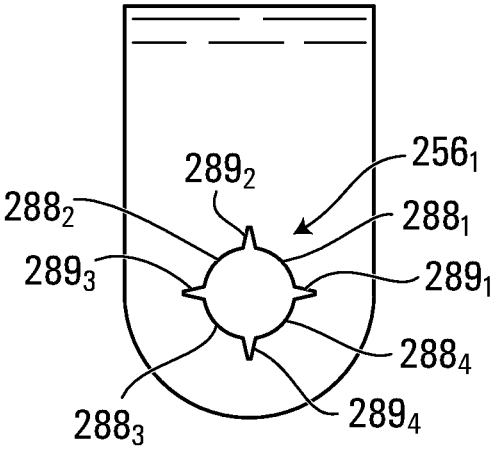
Figure 33:
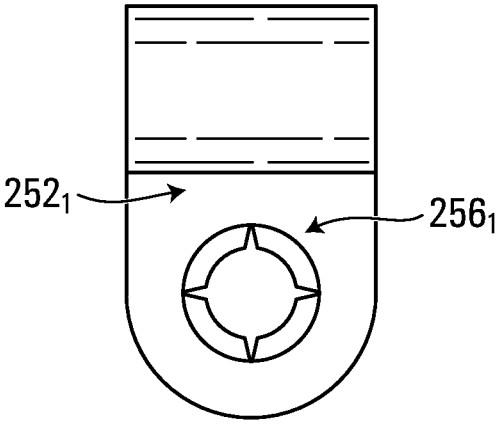
Figure 34:
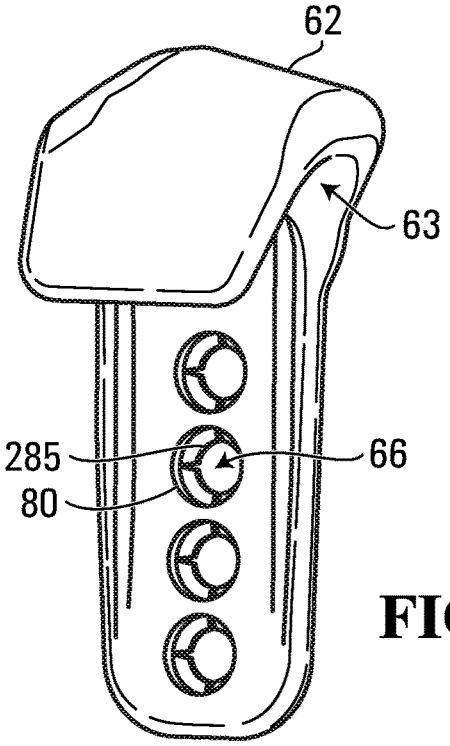
Figure 35:
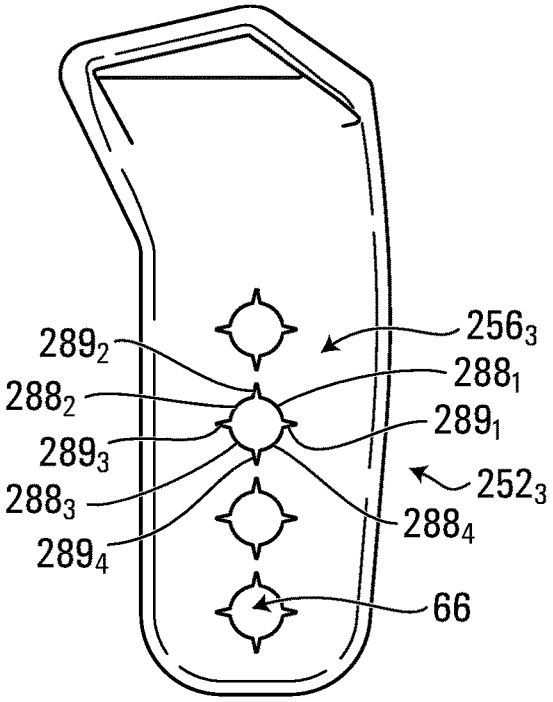
Figure 36:
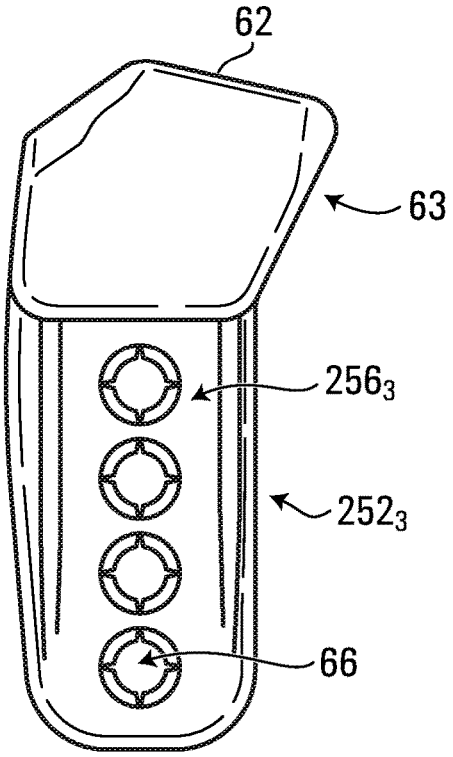

An example of a method to fasten the faceguard 14 to the helmet 10 is shown in FIG. 32. The faceguard 14 is initially prepared, whereby the fasteners $54_1$-$54_6$ are introduced into the mounts $52_1$-$52_4$ and pushed through the retainers $56_1$-$56_3$ which keep the mounts $52_1$-$52_4$ and the fasteners $54_1$-$54_6$ together. This may be done at a time and/or a location before the faceguard 14 is to be fastened to the helmet 10 (e.g., a retail store or other location selling or otherwise providing the helmet 10 and/or the faceguard 14). When assembling the faceguard 14 and the helmet 10, the fasteners $54_1$-$54_6$ retained together with the mounts $52_1$-$52_4$ by the retainers $56_1$-$56_3$ are aligned with and secured to (e.g., screwed into) faceguard-mounting openings $69_1$-$69_6$ of the helmet 10 in order to fasten the faceguard 14 to the helmet 10. In embodiments where one or more of the retainers $56_1$-$56_3$ are removable, this can be performed by removing the one or more of the retainers $56_1$-$56_3$ from the helmet 10, leaving the faceguard 14 fastened to the helmet 10 by the fasteners $54_1$-$54_6$ in the mounts $52_1$-$52_4$.

The helmet 10, the faceguard 14, and/or the fastening system 50 may be implemented in various other ways in other embodiments.

For example, while in embodiments discussed above they are arranged in certain ways, the retainers $56_1$-$56_3$ may be arranged in various other ways in other embodiments. For instance, in some embodiments, instead of being disposed behind the front clip 60 of each of the front mounts $52_1$, $52_2$, the retainer $56_1$ may be disposed in front of or inserted in the front clip 60 of each of the front mounts $52_1$, $52_2$.

In some embodiments, as shown in FIGS. 23 to 29, the faceguard 14 comprises a visor 42.

The visor 42 is transparent to allow the user to see through the visor 42 and is configured to withstand impacts during play. Thus, the visor 42 constitutes a clear shield comprising a lens 70 to protect at least part of the user's face against impacts. Although the visor 42 is transparent, at least part of the visor 42 may be tinted in some embodiments.

The visor 42 may have any suitable size. In this embodiment, the visor 42 is dimensioned to cover an eye region of the user's face to protect his/her eyes and to not cover a mouth region of the user's face. This may facilitate air circulation. The visor 42 may cover a smaller or greater extent of the user's face (e.g., all of the user's face including the mouth region) in other embodiments.

The visor 42 may comprise any suitable material. For example, in this embodiment, the visor 42 comprises polymeric material having suitable impact-resistance. More particularly, in this example of implementation, the polymeric material of the visor 42 is polycarbonate. The visor 42 may comprise any other suitable polymeric material and/or any other type of material in other examples of implementation (e.g., clear nylon, urethane-based material, polymethyl methacrylate, etc.).

In this embodiment, the fastening system 50, which will be designated "150", comprises mounts $\mathbf{152}_1$,$\mathbf{152}_2$ configured to mount the faceguard 14 to the helmet 10, fasteners $\mathbf{154}_1$-$\mathbf{154}_4$ configured to fasten the faceguard 14 to the helmet 10 via the mounts $\mathbf{152}_1$,$\mathbf{152}_2$, spacers $\mathbf{153}_1$, $\mathbf{153}_2$, and retainers $\mathbf{156}_1$, $\mathbf{156}_2$ configured to retain given ones of the fasteners $\mathbf{154}_1$-$\mathbf{154}_4$ and respective ones of the mounts $\mathbf{152}_1$-$\mathbf{152}_2$ as well as respective ones of the spacers $\mathbf{153}_1$, $\mathbf{153}_2$ before the faceguard 14 is fastened to the helmet 10.

In this example of implementation the mounts $\mathbf{152}_1$, $\mathbf{152}_2$ are lateral mounts configured to mount lateral portions $\mathbf{160}_1$, $\mathbf{160}_2$ of the faceguard 14 that are opposite one another to the lateral portions 25L, 25R of the helmet 10 that are opposite one another. In this case, each of the lateral mounts $\mathbf{152}_1$, $\mathbf{152}_2$, designated "$\mathbf{152}_x$", include openings $\mathbf{180}_1$-$\mathbf{180}_4$ in the lateral portions $\mathbf{160}_1$, $\mathbf{160}_2$ of the faceguard 14. In this example, each of the mounts $\mathbf{152}_1$,$\mathbf{152}_2$ comprises at least one opening 180 to receive at least one of the fasteners $\mathbf{154}_1$-$\mathbf{154}_4$ allowing for the faceguard 14 to be fastened to the helmet 10.

In this embodiment, the retainer $\mathbf{156}_1$ is configured to retain the fasteners $\mathbf{154}_1$, $\mathbf{154}_2$, spacer $\mathbf{153}_1$ and mount $\mathbf{152}_1$ together before the faceguard 14 is fastened to the helmet 10. Also, the retainer $\mathbf{156}_2$ is configured to retain fasteners $\mathbf{154}_3$, $\mathbf{154}_4$, spacer $\mathbf{153}_2$ and the lateral mount $\mathbf{152}_2$ together before the faceguard 14 is fastened to the helmet 10.

Each of the retainers $\mathbf{156}_1$,$\mathbf{156}_2$ which will be designated "$\mathbf{156}_x$" may be implemented in any suitable way.

In this embodiment, the retainer $\mathbf{156}_x$ is configured to retain a given one of the fasteners $\mathbf{154}_1$-$\mathbf{154}_4$ which is designated as "$\mathbf{154}_y$", by pushing the fastener $\mathbf{154}_y$ through the spacers $\mathbf{153}_1$,$\mathbf{153}_2$ and the retainer $\mathbf{156}_x$. Thus, the retainer $\mathbf{156}_x$ may screwlessly retain the fastener $\mathbf{154}_y$, i.e., retains the fastener $\mathbf{154}_y$ without screwing the fastener $\mathbf{154}_y$ into the retainer $\mathbf{156}_x$.

More particularly, in this embodiment the retainer $\mathbf{156}_x$ is planar. In this example, the retainer $\mathbf{156}_x$ is a plate. This may help reduce noticeability and/or weight of the retainer $\mathbf{156}_x$ (e.g., it remains on the helmet 10 when the faceguard 14 is fastened to the helmet 10). The retainer $\mathbf{156}_x$ is clear, which may also contribute to making it less noticeable. In this example, the retainer $\mathbf{156}_x$ comprises a polymeric material. For instance, the polymeric material of the retainer $\mathbf{156}_x$ may include at least one of polyethylene, polycarbonate and acrylic, or any other suitable material.

In this example of implementation, a thickness of the retainer $\mathbf{156}_x$ is less than a length of a given one of the fastener $\mathbf{154}_1$-$\mathbf{154}_4$ that it receives. For instance, in some embodiments, the thickness of the retainer $\mathbf{156}_x$ may be no more than 1.5 mm, in some cases no more than 1.3 mm, and in some cases no more than 1 mm.

In this embodiment, the retainer $\mathbf{156}_x$ comprises at least one opening 166 to receive at least one of the fasteners $\mathbf{154}_1$-$\mathbf{154}_4$ that it retains. More particularly, in this embodiment, a given one of the fasteners $\mathbf{154}_1$-$\mathbf{154}_4$ can be pushed through openings $\mathbf{58}_1$-$\mathbf{58}_4$ of the spacers $\mathbf{153}_1$, $\mathbf{153}_2$ and through the opening 166 of the retainer $\mathbf{156}_x$ and retained therein by being pushed therethrough. In this example, the opening 166 of the retainer $\mathbf{156}_x$ is threadless. Also, in this case, each of the fasteners $\mathbf{154}_1$-$\mathbf{154}_4$ is threaded, i.e., includes a thread 177, and a diameter of the opening 166 of the retainer $\mathbf{156}_x$ is less than an outer diameter of the thread 177 of the given one of the fasteners $\mathbf{154}_1$-$\mathbf{154}_4$ that it receives. This facilitates retention. Furthermore, in this example, the retainer $\mathbf{156}_x$ comprises a faster-insertion-facilitating split 189 spaced from a periphery of the retainer $\mathbf{156}_x$ and contiguous to the opening 166 of the retainer $\mathbf{156}_x$. In this case, the fasteners $\mathbf{154}_1$-$\mathbf{154}_4$ are screws.

In some cases, the retainer $\mathbf{156}_x$ may be removable from the faceguard 14. This allows the retainer $\mathbf{156}_x$ to be removed from the faceguard 14 once the faceguard 14 is fastened to the helmet 10 (e.g., to avoid keeping the retainer $\mathbf{156}_x$ on the helmet 14, reduce weight in use, etc.). For example, in this embodiment, the retainer $\mathbf{156}_x$ comprises, for each of its at least one opening 166, a line of weakness 157 configured to facilitate removal of the retainer $\mathbf{156}_x$ from the faceguard 14. In this example, the line of weakness 157 of the retainer $\mathbf{156}_x$ comprises a retainer-removal-facilitating split 198 which extends to the periphery of the retainer $\mathbf{156}_x$ In this embodiment, the retainer-removal-facilitating split 198 of the retainer $\mathbf{156}_x$ is wider than the fastener-insertion-facilitating split 189 of the retainer $\mathbf{156}_x$. Alternatively, in some cases, the retainer-removal-facilitating split 198 of the retainer $\mathbf{156}_x$ may be as wide as the fastener-insertion-facilitating split 189 of the retainer $\mathbf{156}_x$ (e.g., if they are cut together). In other embodiments, the retainer $\mathbf{156}_x$ may be permanent on the faceguard 14 (e.g., the retainer-removal-facilitating split 198 may be omitted).

More particularly, in this embodiment, each opening 180 of the mounts $\mathbf{152}_1$, $\mathbf{152}_2$ may be an aperture of any configuration. For instance, in this example, it may be a slot that can provide adjustability in order to facilitate fastening of the faceguard 14 to the helmet 10.

In this embodiment, the spacers $\mathbf{153}_1$, $\mathbf{153}_2$ separate end portions (e.g., heads) of the fasteners $\mathbf{154}_1$-$\mathbf{154}_4$ from the retainers $\mathbf{156}_1$-$\mathbf{156}_2$ and are configured to space the lens 70 from the helmet 10. The spacers $\mathbf{153}_1$, $\mathbf{153}_2$ comprise openings $\mathbf{58}_1$-$\mathbf{58}_4$, whereby the fasteners $\mathbf{154}_1$-$\mathbf{154}_4$ are introduced into the mounts $\mathbf{152}_1$, $\mathbf{152}_2$ and pushed through the spacers $\mathbf{153}_1$, $\mathbf{153}_2$ and the retainers $\mathbf{156}_1$,$\mathbf{156}_2$ before the faceguard 14 is fastened to the helmet 10. The spacers $\mathbf{153}_1$,$\mathbf{153}_2$ are clear, which may also contribute to making it less noticeable. In this example, the spacers $\mathbf{153}_1$, $\mathbf{153}_2$ comprise a polymeric material. For instance, the polymeric material of the spacers $\mathbf{153}_1$, $\mathbf{153}_2$ may include at least one of polyethylene, polycarbonate and acrylic, or any other suitable material.

An example of a method to fasten the faceguard 14 to the helmet 10 is shown in FIG. 32. The faceguard 14 is initially prepared, whereby the fasteners $\mathbf{154}_1$-$\mathbf{154}_4$ are introduced into the mounts $\mathbf{152}_1$, $\mathbf{152}_2$ and pushed through the spacers $\mathbf{153}_1$, $\mathbf{153}_2$ and the retainers $\mathbf{156}_1$, $\mathbf{156}_2$ which keep the mounts $\mathbf{152}_1$, $\mathbf{152}_2$, the spacers $\mathbf{153}_1$, $\mathbf{153}_2$ and the fasteners $\mathbf{154}_1$, $\mathbf{154}_4$ together. This may be done at a time and/or a location before the faceguard 14 is to be fastened to the helmet 10 (e.g., a retail store or other location selling or otherwise providing the helmet 10 and/or the faceguard 14). When assembling the faceguard 14 and the helmet 10, the fasteners $\mathbf{154}_1$-$\mathbf{154}_4$ retained together with the mounts $\mathbf{152}_1$, $\mathbf{152}_2$ by the retainers $\mathbf{156}_1$, $\mathbf{156}_2$ are aligned with and secured to (e.g., screwed into) faceguard-mounting openings $\mathbf{180}_1$-$\mathbf{180}_4$ of the helmet 10 in order to fasten the faceguard 14 to the helmet 10. In embodiments where one or more of the retainers $\mathbf{156}_1$, $\mathbf{156}_2$ are removable, this can be performed by removing the one or more of the retainers $\mathbf{156}_1$, $\mathbf{156}_2$ from the helmet 10, leaving the faceguard 14 fastened to the helmet 10 by the fasteners $\mathbf{154}_1$-$\mathbf{154}_4$ in the mounts $\mathbf{152}_1$, $\mathbf{152}_2$.

Figure 30:
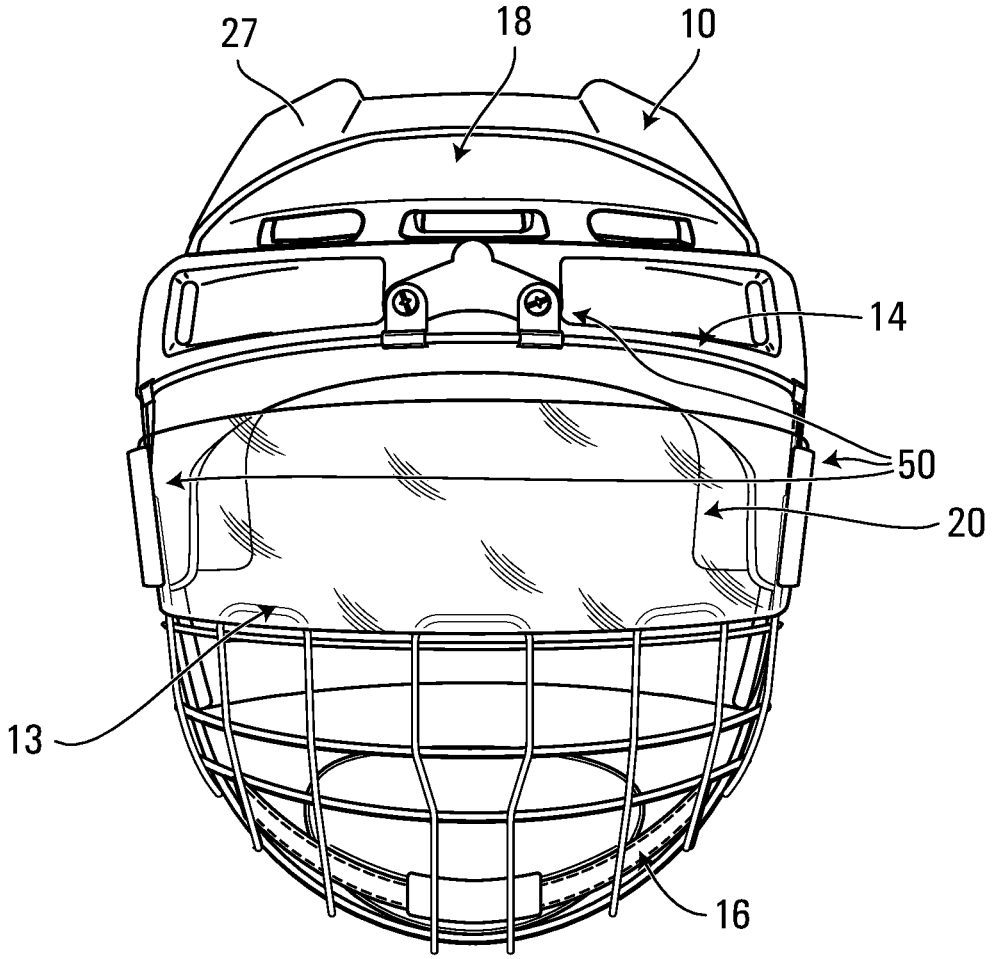
FIG. 30 shows an example of a variant of the helmet wherein the helmet comprises a visor and a grid.
Figure 31:
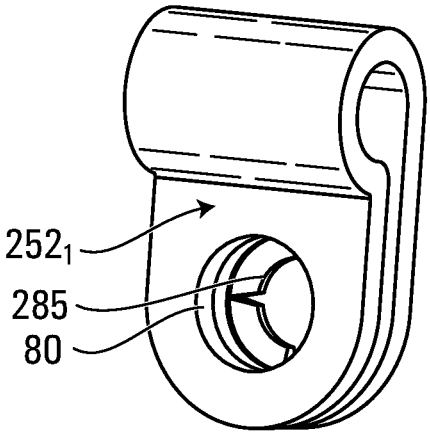
FIGS. 31 to 36 show examples of variants for the fastening system of the faceguard.

In other embodiments, as shown in FIG. 30, the faceguard 14 may comprise both the grid 26 and the visor 42 (e.g., a "hybrid" faceguard).

Figure 37:
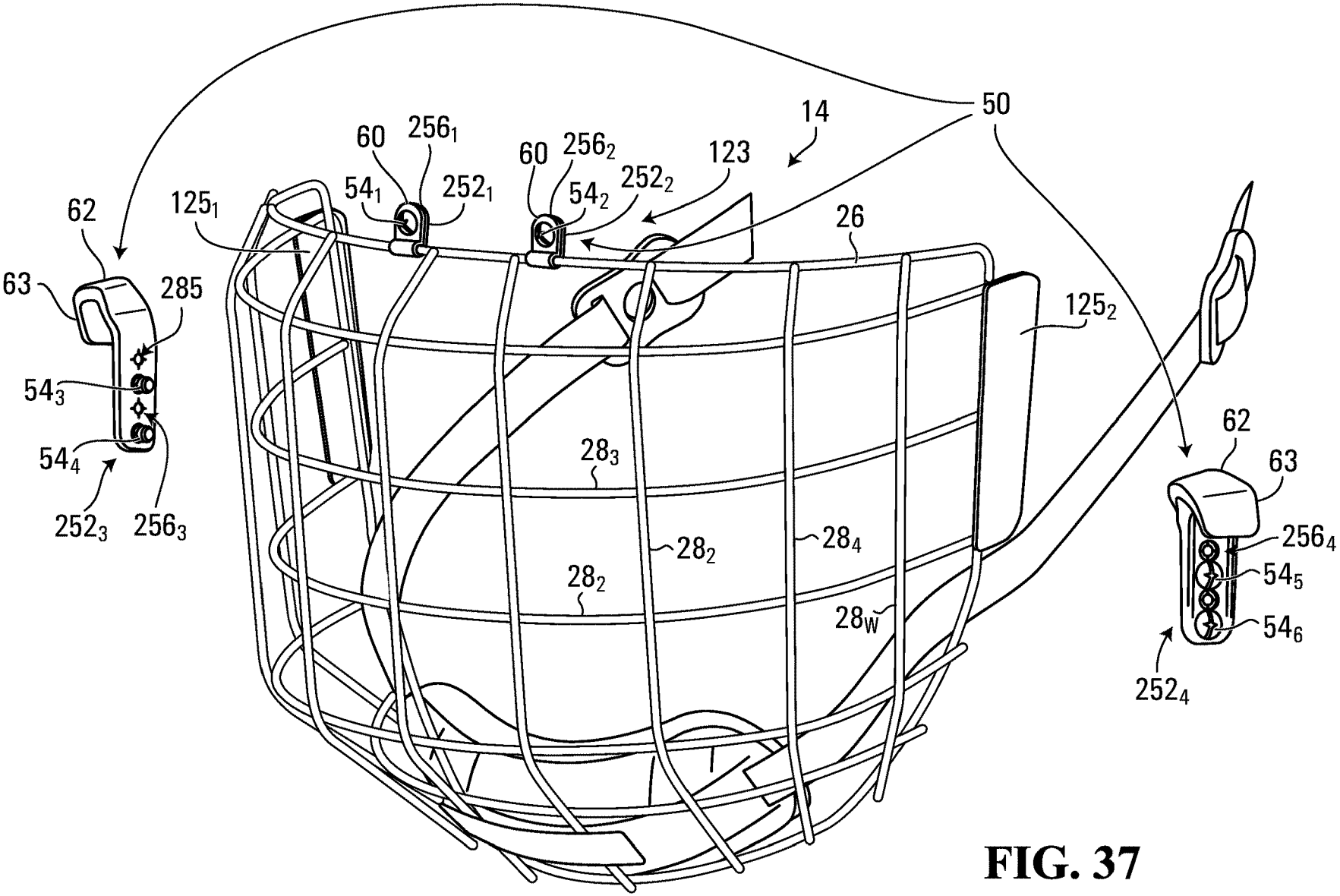
FIG. 37 shows an assembled view of the faceguard with an example of variants for the fastening system.

In some embodiments, as shown in FIG. 37, retainers $\mathbf{256}_1$-$\mathbf{256}_4$ similar to the retainers $\mathbf{56}_1$-$\mathbf{56}_3$ may be integrated with mounts $\mathbf{252}_1$-$\mathbf{252}_4$ similar to the mounts $\mathbf{52}_1$-$\mathbf{52}_4$ such that a given one of the retainers $\mathbf{256}_1$-$\mathbf{256}_4$ and a given one of the mounts $\mathbf{252}_1$-$\mathbf{252}_4$ constitute a one-piece element. More particularly, in this example, the retainer $\mathbf{256}_1$ is formed integrally with the mount $\mathbf{252}_1$, the retainer $\mathbf{256}_2$ is formed integrally with the mount $\mathbf{252}_2$, the retainer $\mathbf{256}_3$ is formed integrally with the mount $\mathbf{252}_3$, and the retainer $\mathbf{256}_4$ is formed integrally with the mount $\mathbf{252}_4$.

In this embodiment, a retainer $\mathbf{256}_x$ of the retainers $\mathbf{256}_1$-$\mathbf{256}_4$ is molded with a mount $\mathbf{252}_x$ of the mounts $\mathbf{252}_1$-$\mathbf{252}_4$ to constitute a one-piece element. For instance, in some embodiments, the retainer $\mathbf{256}_x$ and the mount $\mathbf{252}_x$ may be injection molded, cast, or otherwise molded together using polymeric, metallic or any other suitable material. In this example, the retainer $\mathbf{256}_x$ includes molded material 285 disposed about an opening 80 of the mount $\mathbf{252}_x$, which is coaxial with an opening 66 of the retainer $\mathbf{256}_x$, to receive a given one of the fasteners $\mathbf{54}_1$-$\mathbf{54}_6$ allowing for the faceguard 14 to be fastened to the helmet 10.

In this embodiment, the molded material 285 of the retainer $\mathbf{256}_x$ is thin (i.e., thinner than the mount $\mathbf{252}_x$) and deformable to allow insertion and retain the given one of the fasteners $\mathbf{54}_1$-$\mathbf{54}_6$.

More particularly, in this embodiment, as shown in FIGS. 31 to 36, the molded material 285 of the retainer $\mathbf{256}_x$ may implement a plurality of retention elements $\mathbf{288}_1$-$\mathbf{288}_4$ spaced apart from one another about the opening 80 of the mount $\mathbf{252}_x$ and the opening 66 of the retainer $\mathbf{256}_x$ (e.g., similar to a female plastic rivet). Also, in this embodiment, the retainer $\mathbf{256}_x$ comprises fastener-insertion-facilitating splits $\mathbf{289}_1$-$\mathbf{289}_4$ between adjacent ones of the retention elements $\mathbf{288}_1$-$\mathbf{288}_4$ in order to facilitate pushing of the given one of the fasteners $\mathbf{54}_1$-$\mathbf{54}_5$ into the opening 66 of the retainer $\mathbf{256}_x$.

The molded material 285 of the retainer $\mathbf{256}_x$ may be implemented in various other ways in other embodiments (e.g., may include fewer or more retention elements such as the retention elements $\mathbf{288}_1$-$\mathbf{288}_4$, etc.).

Although in embodiments considered above the helmet 10 is a hockey helmet, in other embodiments, the helmet 10 may be any other helmet usable by a user playing another type of contact sport (e.g., a "full-contact" sport) in which there are significant impact forces on the user due to player-to-player and/or player-to-object contact or any other type of sports, including athletic activities other than contact sports.

Figure 38:
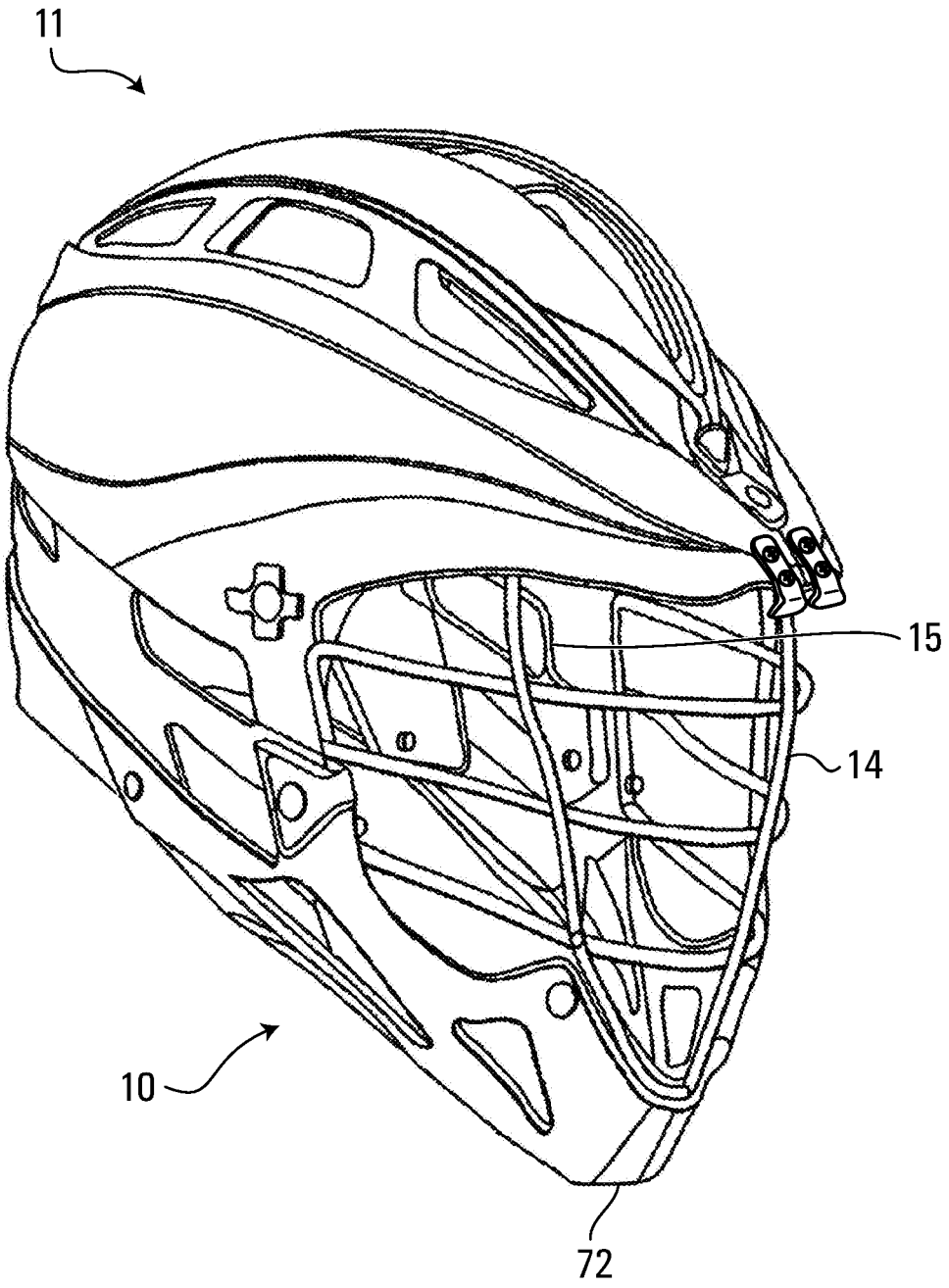
FIG. 38 shows an example of a variant of the helmet wherein the helmet is a lacrosse helmet.
Figure 39:
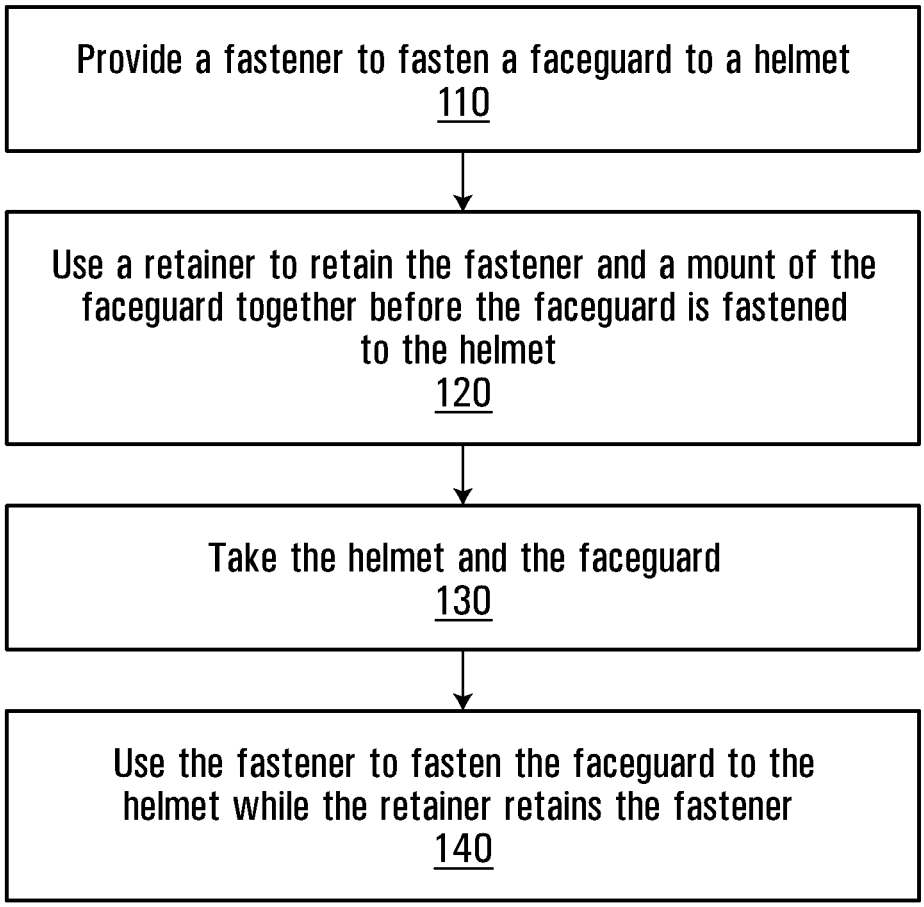
FIG. 39 shows a method of fastening the faceguard to the helmet.

For example, in other embodiments, as shown in FIG. 38, the helmet 10 may be a lacrosse helmet. The lacrosse helmet 10 comprises a chin piece 72 extending from the left lateral side portion 25L to the right lateral side portion 25R of the helmet 10 and configured to extend in front of a chin area of the user. The lacrosse helmet 10 is also provided with the faceguard 14 which is connected to the shell 11 and the chin piece 72.

In other embodiments, the helmet 10 may be a baseball/softball helmet or any other type of helmet, which may be provided with the faceguard 14.

Certain additional elements that may be needed for operation of some embodiments have not been described or illustrated as they are assumed to be within the purview of those of ordinary skill in the art. Moreover, certain embodiments may be free of, may lack and/or may function without any element that is not specifically disclosed herein.

Any feature of any embodiment discussed herein may be combined with any feature of any other embodiment discussed herein in some examples of implementation.

In case of any discrepancy, inconsistency, or other difference between terms used herein and terms used in any document incorporated by reference herein, meanings of the terms used herein are to prevail and be used.

Although various embodiments and examples have been presented, this was for purposes of describing, but should not be limiting. Various modifications and enhancements will become apparent to those of ordinary skill and are within a scope of this disclosure.

The invention claimed is:

1. A system for a helmet worn by a user engaging in a sport, the system comprising:

a faceguard comprising a grid to protect at least part of a face of the user, the grid comprising a plurality of openings such that the face of the user is exposed to a surrounding environment through the openings of the grid;

a plurality of mounts configured to mount the faceguard to the helmet;

a plurality of threaded fasteners configured to fasten the faceguard to the helmet; and a retainer configured to retain a first one of the threaded fasteners, a second one of the threaded fasteners, and a first one of the mounts together before the faceguard is fastened to the helmet, the retainer extending from the first one of the threaded fasteners to the second one of the threaded fasteners, wherein:

the retainer is removable from the faceguard and the helmet while the first one of the threaded fasteners and the second one of the threaded fasteners fasten the faceguard to the helmet such that, when the retainer is removed from the faceguard and the helmet, the faceguard fastened to the helmet is configured to be used by the user while engaging in the sport; and the retainer comprises a line of weakness configured to facilitate removal of the retainer from the faceguard.

2. The system of claim 1, wherein the first one of the mounts comprises a clip.

3. The system of claim 2, wherein the clip is a J-clip.

4. The system of claim 1, wherein the first one of the mounts comprises an opening to receive the first one of the threaded fastener.

5. The system of claim 1, wherein the retainer retains the first one of the threaded fasteners and the first one of the mounts together before the faceguard is fastened to the helmet and retains the second one of the threaded fasteners and a second one of the mounts together before the faceguard is fastened to the helmet.

6. The system of claim 1, wherein: the retainer is a first fastener; and the faceguard comprises a second retainer retaining a third one of the threaded fasteners and a second one of the mounts together before the faceguard is fastened to the helmet.

7. The system of claim 6, wherein the faceguard comprises a third retainer retaining a fourth one of the threaded fasteners and a third one of the mounts together before the faceguard is fastened to the helmet.

8. The system of claim 1, wherein the first one of the mounts is configured to be located in a front portion of the helmet.

9. The system of claim 1, wherein the first one of the mounts is configured to be located in a lateral portion of the helmet.

10. The system of claim 5, wherein the first one of the mounts and the second one of the mounts are configured to be located in a front portion of the helmet.

11. The system of claim 6, wherein the first one of the mounts is configured to be located in a first lateral portion of the helmet and the second one of the mounts is configured to be located in a second lateral portion of the helmet opposite to the first lateral portion of the helmet.

12. The system of claim 6, wherein the first one of the mounts is configured to be located in a front portion of the helmet and the second one of the mounts is configured to be located in a lateral portion of the helmet.

13. The system of claim 1, wherein the first one of the threaded fasteners and the second one of the threaded fasteners are pushed through the retainer such that the retainer retains the first one of the threaded fasteners and the second one of the threaded fasteners.

14. The system of claim 1, wherein the retainer screwlessly retains the first one of the threaded fasteners and the second one of the threaded fasteners.

15. The system of claim 1, wherein the retainer comprises a first opening to receive the first one of the threaded fasteners and a second opening to receive the second one of the threaded fasteners.

16. The system of claim 15, wherein the first one of the threaded fasteners is pushed through the first opening of the retainer such that the retainer retains the first one of the threaded fasteners and the second one of the threaded fasteners is pushed through the second opening of the retainer such that the retainer retains the second one of the threaded fasteners.

17. The system of claim 15, wherein: the first one of the threaded fasteners comprises a thread; and a diameter of the first opening of the retainer is less than an outer diameter of the thread of the first one of the threaded fasteners.

18. The system of claim 15, wherein the first opening and the second opening of the retainer are threadless.

19. The system of claim 15, wherein the retainer comprises: a first split contiguous to the first opening of the retainer to facilitate pushing of the first one of the threaded fasteners into the first opening of the retainer; and a second split contiguous to the second opening of the retainer to facilitate pushing of the second one of the threaded fasteners into the second opening of the retainer.

20. The system of claim 19, wherein each of the first split of the retainer and the second split of the retainer is a slit.

21. The system of claim 15, wherein the retainer comprises a plurality of splits contiguous to the first opening of the retainer.

22. The system of claim 1, wherein the retainer is planar.

23. The system of claim 1, wherein the retainer is a plate.

24. The system of claim 1, wherein the retainer comprises polymeric material.

25. The system of claim 1, wherein a thickness of the retainer is less than a length of the first one of the threaded fasteners.

26. The system of claim 1, wherein a thickness of the retainer is no more than 1.5 mm.

27. The system of claim 1, wherein the line of weakness comprises a split extending to a periphery of the retainer.

28. The system of claim 1, wherein: the retainer comprises an opening to receive the first one of the threaded fasteners; the retainer comprises a split contiguous to the opening of the retainer to facilitate pushing of the first one of the threaded fasteners into the opening of the retainer; and the line of weakness of the retainer is wider than the split of the retainer.

29. The system of claim 28, wherein: the split of the retainer is a fastener-insertion-facilitating split spaced from a periphery of the retainer; and the line of weakness of the retainer comprises a retainer-removal-facilitating split extending to a periphery of the retainer.

30. The system of claim 1, wherein the first one of the threaded fasteners and the second one of the threaded fasteners are screws.

31. The system of claim 1, wherein the retainer retains the first one of the threaded fasteners, the second one of the threaded fasteners, the first one of the mounts, and a second one of the mounts together.

32. The system of claim 1, wherein the first one of the mounts comprises a first opening to receive the first one of the threaded fasteners and a second opening to receive the second one of the threaded fasteners.

33. The system of claim 1, wherein each of at least two of the openings of the grid is larger than the retainer such that the retainer is able to pass through each of the at least two of the openings of the grid.

34. A system for a helmet worn by a user engaging in a sport, the system comprising:

a faceguard comprising a grid to protect at least part of a face of the user, the grid comprising a plurality of openings such that the face of the user is exposed to a surrounding environment through the openings of the grid;

a plurality of mounts configured to mount the faceguard to the helmet;

a plurality of threaded fasteners configured to fasten the faceguard to the helmet; and a retainer configured to retain a first one of the threaded fasteners, a second one of the threaded fasteners, and a first one of the mounts together before the faceguard is fastened to the helmet, the retainer extending from the first one of the threaded fasteners to the second one of the threaded fasteners, wherein:

the retainer is removable from the faceguard and the helmet while the first one of the threaded fasteners and the second on of the threaded fasteners fasten the faceguard to the helmet such that, when the retainer is removed from the faceguard and the helmet, the faceguard fastened to the helmet is configured to be used by the user while engaging in the sport; and each of at least two of the openings of the grid is larger than the retainer such that the retainer is able to pass through each of the at least two of the openings of the grid.

35. The system of claim 34, wherein the retainer retains the first one of the threaded fasteners, the second one of the threaded fasteners, the first one of the mounts, and a second one of the mounts together.

36. A system for a helmet worn by a user engaging in a sport, the system comprising:

a faceguard comprising a grid to protect at least part of a face of the user, the grid comprising a plurality of openings such that the face of the user is exposed to a surrounding environment through the openings of the grid;

a plurality of mounts configured to mount the faceguard to the helmet;

a plurality of threaded fasteners configured to fasten the faceguard to the helmet; and a retainer configured to retain a first one of the threaded fasteners, a second one of the threaded fasteners, and a first one of the mounts together before the faceguard is fastened to the helmet, the retainer extending from the first one of the threaded fasteners to the second one of the threaded fasteners, wherein:

the retainer is removable from the faceguard and the helmet while the first one of the threaded fasteners and the second one of the threaded fasteners fasten the faceguard to the helmet such that, when the retainer is removed from the faceguard and the helmet, the faceguard fastened to the helmet is configured to be used by the user while engaging in the sport, the retainer comprising:

a first opening to receive the first one of the threaded fasteners and a second opening to receive the second one of the threaded fasteners; and a first split contiguous to the first opening of the retainer to facilitate pushing of the first one of the threaded fasteners into the first opening of the retainer; and a second split contiguous to the second opening of the retainer to facilitate pushing of the second one of the threaded fasteners into the second opening of the retainer.

37. The system of claim 36, wherein the retainer retains the first one of the threaded fasteners, the second one of the threaded fasteners, the first one of the mounts, and a second one of the mounts together.

38. A system for a helmet worn by a user playing hockey or lacrosse, the system comprising:

a faceguard comprising a grid or visor to protect against impacts from a puck or ball;

a plurality of mounts configured to mount the faceguard to the helmet;

a plurality of threaded fasteners configured to fasten the faceguard to the helmet; and a retainer configured to retain a first one of the threaded fasteners, a second one of the threaded fasteners, and a first one of the mounts together before the faceguard is fastened to the helmet, the retainer extending from the first one of the threaded fasteners to the second one of the threaded fasteners, wherein the retainer is removable from the faceguard and the helmet while the first one of the threaded fasteners and the second one of the threaded fasteners fasten the faceguard to the helmet such that, when the retainer is removed from the faceguard and the helmet, the faceguard fastened to the helmet is configured to be used by the user while playing hockey or lacrosse, the retainer is a first retainer and the faceguard comprises a second retainer retaining a third one of the threaded fasteners and a second one of the mounts together before the faceguard is fastened to the helmet.

* * * * *